US011598334B2

(12) United States Patent
Kato et al.

(10) Patent No.: US 11,598,334 B2
(45) Date of Patent: Mar. 7, 2023

(54) VANE PUMP HAVING A SIDE MEMBER INCLUDING A TRIANGULAR-SHAPED PROTRUDING OPENING PORTION IN COMMUNICATION WITH A BACK PRESSURE OPENING PORTION FOR PREVENTING WEAR OF AN INNER CIRCUMFERENCE CAM FACE

(71) Applicant: KYB Corporation, Tokyo (JP)

(72) Inventors: Fumiyasu Kato, Aichi (JP); Koichiro Akatsuka, Gifu (JP)

(73) Assignee: KYB CORPORATION, Tokyo (JP)

( * ) Notice: Subject to any disclaimer, the term of this patent is extended or adjusted under 35 U.S.C. 154(b) by 186 days.

(21) Appl. No.: 16/765,133

(22) PCT Filed: Nov. 9, 2018

(86) PCT No.: PCT/JP2018/041724
§ 371 (c)(1),
(2) Date: May 18, 2020

(87) PCT Pub. No.: WO2019/098140
PCT Pub. Date: May 23, 2019

(65) Prior Publication Data

US 2020/0347844 A1 Nov. 5, 2020

(30) Foreign Application Priority Data

Nov. 20, 2017 (JP) ..... JP2017-222945

(51) Int. Cl.
*F04C 2/344* (2006.01)
*F04C 14/22* (2006.01)
(Continued)

(52) U.S. Cl.
CPC ..... *F04C 2/344* (2013.01); *F04C 14/223* (2013.01); *F01C 21/0836* (2013.01);
(Continued)

(58) Field of Classification Search
CPC .. F04C 2/344; F04C 14/223; F04C 2210/206; F04C 2240/20; F01C 21/0836; F01C 21/0863; F01C 21/108
See application file for complete search history.

(56) References Cited

U.S. PATENT DOCUMENTS

2017/0184104 A1 6/2017 Nishikawa

FOREIGN PATENT DOCUMENTS

JP H1193857 A * 4/1999
JP 2017-061904 A 3/2017
(Continued)

*Primary Examiner* — Dominick L Plakkoottam
*Assistant Examiner* — Paul W Thiede
(74) *Attorney, Agent, or Firm* — Rabin & Berdo, P.C.

(57) ABSTRACT

A vane pump includes a rotor having slits, vanes received in the slits, a cam ring having an inner circumference cam face with which the vanes are brought into sliding contact, a side member, pump chambers formed by the rotor, the cam ring, and adjacent vanes, and back pressure chambers formed in the slits by the vanes. In the vane pump, the side member is provided with a back pressure opening portion opening at a sliding-contact surface in sliding contact with the rotor, the back pressure opening portion being configured to communicate with the back pressure chambers, and a protruding opening portion protruding along the rotating direction of the rotor from an end portion of the back pressure opening portion on the communication-finishing side. An inner-side inner circumferential surface of the protruding opening portion is connected to an inner-side inner circumferential surface of the back pressure opening portion.

8 Claims, 16 Drawing Sheets

(51) Int. Cl.
*F01C 21/08* (2006.01)
*F01C 21/10* (2006.01)

(52) U.S. Cl.
CPC ..... *F01C 21/0863* (2013.01); *F01C 21/108* (2013.01); *F04C 2210/206* (2013.01); *F04C 2240/20* (2013.01)

(56) References Cited

FOREIGN PATENT DOCUMENTS

| | | | |
|---|---|---|---|
| JP | 2017-115843 | A | 6/2017 |
| JP | 2017166357 | A | 9/2017 |

* cited by examiner

VANE PUMP HAVING A SIDE MEMBER INCLUDING A TRIANGULAR-SHAPED PROTRUDING OPENING PORTION IN COMMUNICATION WITH A BACK PRESSURE OPENING PORTION FOR PREVENTING WEAR OF AN INNER CIRCUMFERENCE CAM FACE

TECHNICAL FIELD

The present invention relates to a vane pump.

BACKGROUND ART

JP2017-61904A describes a vane pump that includes a rotor that is formed with a plurality of slits extending in the radial directions, and a plurality of vanes that are respectively accommodated in the slits in a slidable manner and that are provided such that tip end surfaces thereof come to slidable contact with a cam face of a cam ring. In the vane pump described in JP2017-61904A, discharged oil is introduced into the slits through back-pressure grooves respectively formed in side plates, and this discharged oil causes the vanes to be pushed against the cam face of the cam ring.

SUMMARY OF INVENTION

With the above-described vane pump, as the rotor is rotated, the vane may temporarily separate away from the cam face. Because a small gap is formed between the vane and each of the side plates, there is a case in which, as the vane separates away from the cam face, the vane is tilted so as to lean towards one of the pair of side plates. In this case, a base-end portion of the vane falls into the back-pressure groove, and there is a possibility that the fallen base-end portion of the vane is caught on an inner circumferential surface of the back-pressure groove.

As the base-end portion of the vane is caught on the inner circumferential surface of the back-pressure groove, the base-end portion of the vane is guided so as to move along the inner circumferential surface of the back-pressure groove by the rotation of the rotor, and the vane is forcedly pushed outwards in the radial direction. As a result, there is a problem in that a tip end portion of the vane is pressed against the cam face, thereby causing wear of the cam face.

An object of the present invention is to prevent wear of an inner circumference cam face of a cam ring.

According to one aspect of the present invention, a vane pump includes: a rotor having a plurality of slits formed in a radiating pattern, the rotor being rotationally driven; a plurality of vanes received in the slits in a freely slidable manner; a cam ring having an inner circumference cam face with which tip end portions of the vanes are brought into sliding contact; a side member brought into contact with one-side surfaces of the rotor and the cam ring; pump chambers formed by the rotor, the cam ring, and adjacent vanes; and back pressure chambers formed in the slits by base-end portions of the vanes. The side member is provided with: a back pressure opening portion opening at a sliding-contact surface in sliding contact with the rotor, the back pressure opening portion being configured to communicate with the back pressure chambers; and a protruding opening portion protruding along a rotating direction of the rotor from an end portion of the back pressure opening portion on a communication-finishing side, where communication between the back pressure opening portion and the back pressure chambers finishes as the rotor is rotated. An inner-side inner circumferential surface of the protruding opening portion is connected to an inner-side inner circumferential surface of the back pressure opening portion.

DESCRIPTION OF EMBODIMENTS

A vane pump according to an embodiment of the present invention will be described below with reference to the drawings.

First Embodiment

A vane pump 100 according to a first embodiment of the present invention is used as a fluid pressure source for a fluid hydraulic apparatus mounted on a vehicle. The fluid hydraulic apparatus includes, for example, power steering apparatus, a continuously variable transmission, or the like. Oil, aqueous alternative fluid of other type, or the like may be used as a working fluid.

Figure 1:
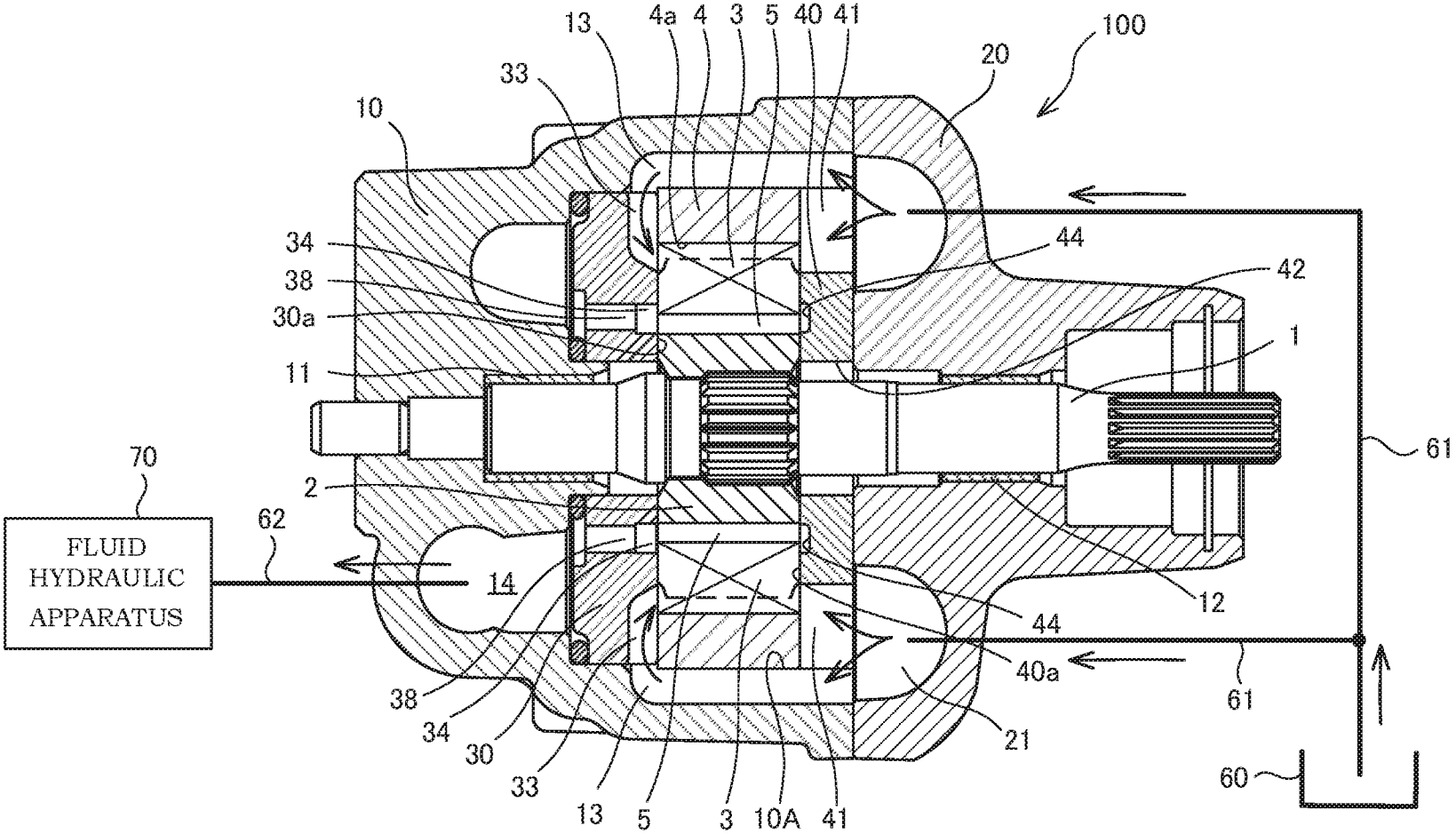
FIG. 1 is a sectional view of a vane pump according to a first embodiment of the present invention.
Figure 2:
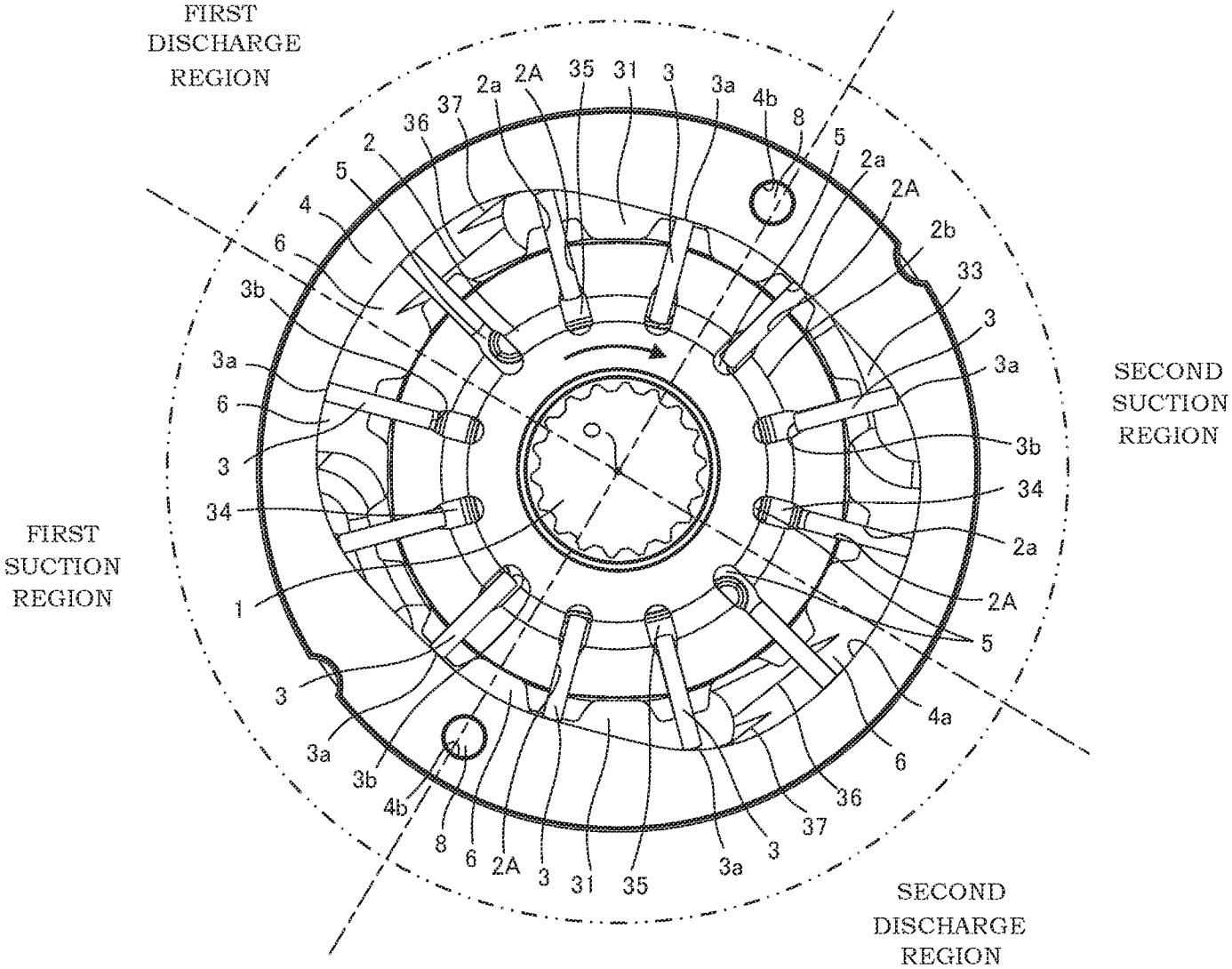
FIG. 2 is a plan view of relevant parts of the vane pump according to the first embodiment of the present invention in a state in which a cover-side side plate of the vane pump has been removed.

As shown in FIGS. 1 and 2, the vane pump 100 is provided with a pump body 10, a pump cover 20, a driving shaft 1, a rotor 2, vanes 3, and a cam ring 4. The pump body 10 is formed with a pump accommodating concave portion 10A. The pump cover 20 covers an opening portion of the pump accommodating concave portion 10A and is fixed to the pump body 10. The driving shaft 1 is rotatably supported by the pump body 10 and the pump cover 20 via bearings 11 and 12. The rotor 2 is linked to the driving shaft 1 and is accommodated in the pump accommodating concave portion 10A. The vanes 3 are respectively received in slits 2A in the rotor 2 in a freely slidable manner. The cam ring 4 accommodates the rotor 2 and the vanes 3 and has an inner circumference cam face 4*a* with which tip end portions 3*a* of the vanes 3 are brought into sliding contact.

The vane pump 100 is driven by, for example, a driving device (not shown), such as an engine, etc., and fluid pressure is generated as the rotor 2 linked to the driving shaft 1 is rotationally driven in the clockwise direction as shown by an arrow in FIG. 2.

In the rotor 2, a plurality of slits 2A are formed in a radiating pattern. The slits 2A respectively have opening portions 2*a* on an outer circumference of the rotor 2.

The vanes 3 are respectively inserted into the slits 2A in a freely slidable manner, and respectively have the tip end portions 3*a* that are end portions in the directions projecting out from the slits 2A and base-end portions 3*b* that are end portions at the opposite side of the tip end portions 3*a*. In the slits 2A, back pressure chambers 5 are respectively formed on the bottom portion side of the slits 2A with the base-end portions 3*b* of the vanes 3. Working oil serving as the working fluid is guided to the back pressure chambers 5. The vanes 3 are pushed by pressure in the back pressure chambers 5 in the direction in which the vanes 3 project out from the slits 2A. In the above configuration, adjacent back pressure chambers 5 are communicated with each other via a communicating groove 2*b* provided in an end surface of the rotor 2.

The cam ring 4 is an annular member having the inner circumference cam face 4*a* serving as an inner circumferential surface having a substantially oval shape and pin holes 4*b* through which positioning pins 8 are inserted. As the vanes 3 are pushed by the pressure in the back pressure chambers 5 in the direction in which the vanes 3 project out from the slits 2A, the tip end portions 3*a* of the vanes 3 are brought into sliding contact with the inner circumference cam face 4*a* of the cam ring 4. With such a configuration, pump chambers 6 are formed in the cam ring 4 by an outer circumferential surface of the rotor 2, the inner circumference cam face 4*a* of the cam ring 4, and the adjacent vanes 3.

Because the inner circumference cam face 4*a* of the cam ring 4 has the substantially oval shape, as the rotor 2 is rotated, the displacement of each of the pump chambers 6, which are formed by the respective vanes 3 in sliding contact with the inner circumference cam face 4*a*, is repeatedly expanded and contracted. The working oil is sucked in suction regions in which the pump chambers 6 are expanded, and the working oil is discharged in discharge regions in which the pump chambers 6 are contracted.

As shown in FIG. 2, the vane pump 100 has a first suction region and a first discharge region, in which the vanes 3 undergo first reciprocating movement, and a second suction region and a second discharge region, in which the vanes 3 undergo second reciprocating movement. While the rotor 2 completes a full rotation, the pump chambers 6 are expanded in the first suction region, contracted in the first discharge region, expanded in the second suction region, and contracted in the second discharge region. Although the vane pump 100 has two suction regions and two discharge regions, the configuration is not limited thereto, and the vane pump 100 may have a configuration in which a single suction region or three or more suction regions and a single discharge region or three or more discharge regions are provided.

As shown in FIG. 1, the vane pump 100 is further provided with a body-side side plate 30 and a cover-side side plate 40. The body-side side plate 30 serves as a first side member that is provided on one end side of the rotor 2 in the axial direction and that comes into contact with one-side surfaces of the rotor 2 and the cam ring 4, and the cover-side side plate 40 serves as a second side member that is provided on the other end side of the rotor 2 in the axial direction and that comes into contact with other-side surfaces of the rotor 2 and the cam ring 4.

The body-side side plate 30 is provided between a bottom surface of the pump accommodating concave portion 10A and the rotor 2. A first end surface of the rotor 2 in the axial direction comes into sliding contact with the body-side side plate 30, and a first end surface of the cam ring 4 in the axial direction comes into contact with the body-side side plate 30. The cover-side side plate 40 is provided between the rotor 2 and the pump cover 20. A second end surface of the rotor 2 in the axial direction comes into sliding contact with the cover-side side plate 40, and a second end surface of the cam ring 4 in the axial direction comes into contact with the cover-side side plate 40. By being configured as described above, the body-side side plate 30 and the cover-side side plate 40 are arranged in a state in which they face both side surfaces of the rotor 2 and the cam ring 4.

The body-side side plate 30, the rotor 2, the cam ring 4, and the cover-side side plate 40 are accommodated in the pump accommodating concave portion 10A of the pump body 10. By attaching the pump cover 20 to the pump body 10 in this state, the pump accommodating concave portion 10A is sealed.

An annular high-pressure chamber 14 is formed by the pump body 10 and the body-side side plate 30 on the bottom surface side of the pump accommodating concave portion 10A of the pump body 10. The high-pressure chamber 14 communicates with an external fluid hydraulic apparatus 70 of the vane pump 100 via a discharge passage 62.

The pump cover 20 is formed with a suction pressure chamber 21, and bypass passages 13 that communicates with the suction pressure chamber 21 is formed in an inner circumferential surface of the pump accommodating concave portion 10A. The bypass passages 13 are respectively provided at two positions that oppose to each other such that the cam ring 4 is located therebetween. The suction pressure chamber 21 is connected to a tank 60 via suction passages 61.

Figure 3:
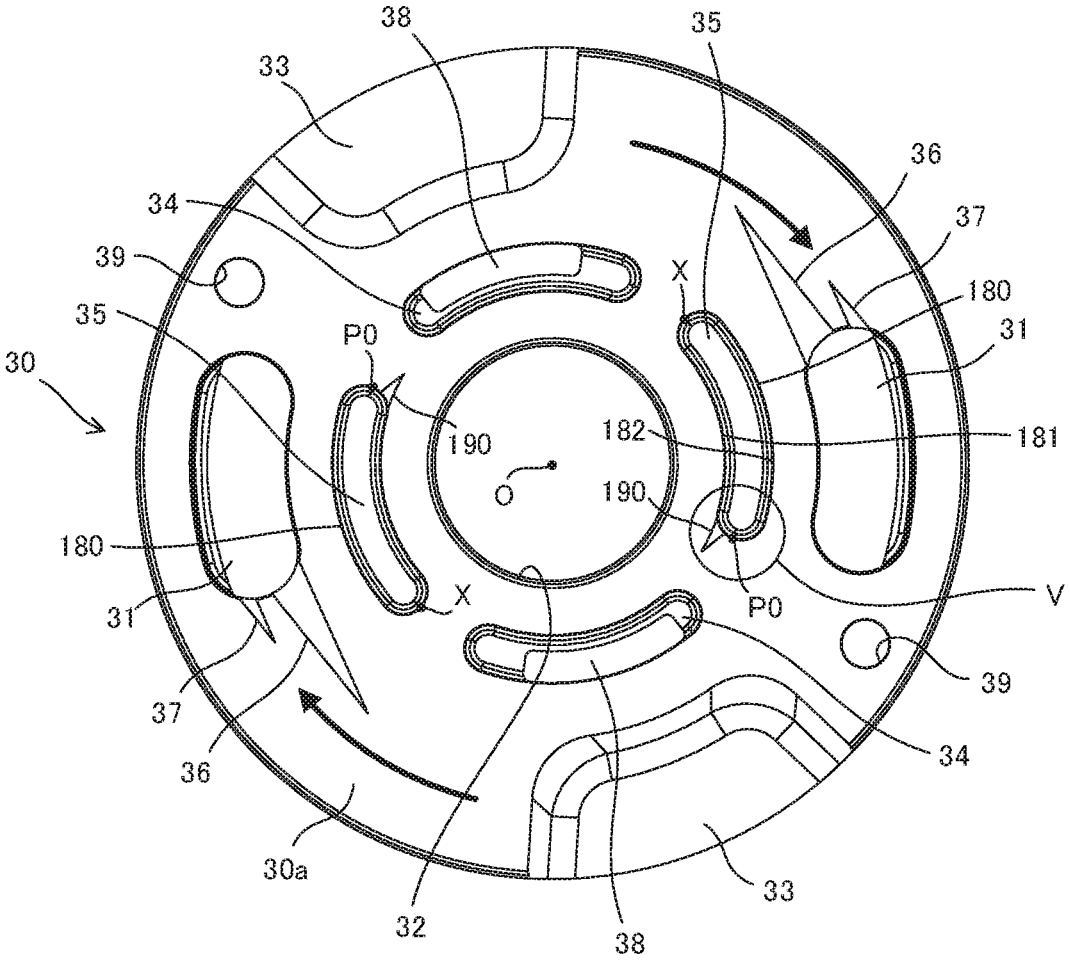
FIG. 3 is a plan view of a body-side side plate in the vane pump according to the first embodiment of the present invention.

As shown in FIG. 3, the body-side side plate 30 is a plate shaped member having a sliding-contact surface 30*a*, discharge ports 31, a through hole 32, suction ports 33, and pin holes 39. The sliding-contact surface 30*a* is in sliding contact with a side surface of the rotor 2. The discharge ports 31 are formed so as to respectively correspond to the first and second discharge regions. The through hole 32 is configured to through which the driving shaft 1 is inserted. The suction ports 33 are formed so as to respectively correspond to the first and second suction regions. The pin holes 39 are configured to through which the positioning pins 8 are inserted.

The discharge ports 31 are respectively provided at two positions that oppose to each other such that the through hole 32 is located therebetween. Each of the discharge ports 31 is formed to have an arc shape centered at the through hole 32. The discharge ports 31 penetrate through the body-side side plate 30 so as to communicate with the high-pressure chamber 14 formed in the pump body 10. The discharge ports 31 discharges the working oil, which has been guided from the pump chambers 6, to the high-pressure chamber 14. The working oil that has flown into the high-pressure chamber 14 is then supplied to the external fluid hydraulic apparatus 70 of the vane pump 100 through the discharge passage 62 (see FIG. 1).

The suction ports 33 are respectively provided at two positions that oppose to each other such that the through hole 32 is located therebetween. The suction ports 33 are formed at positions corresponding to the bypass passages 13 of the pump accommodating concave portion 10A. Each of the suction ports 33 is formed so as to have a concave shape that opens on the outer side in the radial direction. Each of the suction ports 33 extends such that its outer circumference ends reach an outer circumferential surface of the body-side side plate 30. The working oil is supplied to the suction ports 33 via the suction pressure chamber 21 and the bypass passages 13 (see FIG. 1), and the suction ports 33 guide the thus supplied working oil into the pump chambers 6.

Outer notches 37 and inner notches 36 having a groove shape are formed in the sliding-contact surface 30*a* of the body-side side plate 30. The outer notches 37 and the inner notches 36 each communicates with each of the discharge ports 31 by being provided on an end portion of the discharge port 31 on the communication-beginning side where the communication between the discharge port 31 and the pump chambers 6 begins as the rotor 2 is rotated. The outer notches 37 and the inner notches 36 are formed such that opening areas are gradually increased in the rotating direction of the rotor 2. The outer notches 37 are arranged on the outer circumferential side of the inner notches 36 and formed such that their lengths in the rotating direction of the rotor 2 are shorter than those of the inner notches 36.

The outer notches 37 and the inner notches 36 are arranged between the outer circumferential surface of the rotor 2 and the inner circumference cam face 4*a* of the cam ring 4 (see FIG. 2). Because the outer notches 37 and the inner notches 36 are formed, a flow of the working oil from the pump chambers 6 to the discharge ports 31 through the outer notches 37 and the inner notches 36 is promoted as the rotor 2 is rotated, and therefore, a sudden pressure change in the high-pressure chamber 14 is prevented.

The sliding-contact surface 30*a* of the body-side side plate 30 is formed with a pair of back-pressure grooves 34 that are formed so as to oppose to each other such that the through hole 32 is located therebetween and a pair of back-pressure grooves 35 that are formed so as to oppose to each other such that the through hole 32 is located therebetween. The pair of back-pressure grooves 35 are provided at positions offset from the pair of back-pressure grooves 34 by about 90° with respect to the through hole 32 as the center. The back-pressure grooves 34 are respectively provided in the first and second suction regions, and the back-pressure grooves 35 are respectively provided in the first and second discharge regions.

The back-pressure grooves 34 and 35 are formed so as to have a groove shape opening at the sliding-contact surface 30*a*. The back-pressure grooves 34 and 35 are formed to have an arc shape centered at the through hole 32 so as to communicate with a plurality of back pressure chambers 5 overlapping with the back-pressure grooves 34 and 35. The back-pressure grooves 34 respectively communicate with communication holes 38 formed so as to penetrate through the body-side side plate 30. With such a configuration, the back-pressure grooves 34 communicate with the high-pressure chamber 14 via the communication holes 38 (see FIG. 1). In the above configuration, because the back pressure chambers 5 are communicated with each other via the communicating groove 2*b* (see FIG. 2), the back-pressure grooves 35 communicate with the back-pressure grooves 34 via the back pressure chambers 5 and the communicating groove 2*b*. In other words, the back-pressure grooves 35 communicate with the high-pressure chamber 14 via the back pressure chambers 5, the communicating groove 2*b*, and the back-pressure grooves 34.

As shown in FIG. 1, similarly to the body-side side plate 30, the cover-side side plate 40 is a plate shaped member having a sliding-contact surface 40*a*, suction ports 41, a through hole 42, and pin holes (not shown). The sliding-contact surface 40*a* is in sliding contact with the side surface of the rotor 2. The suction ports 41 are formed so as to respectively correspond to the first and second suction regions. The through hole 42 is configured to through which the driving shaft 1 is inserted. The pin holes are configured to through which the positioning pins 8 are inserted. The cover-side side plate 40 is aligned by the positioning pins 8 with respect to the cam ring 4 and the body-side side plate 30.

The suction ports 41 are respectively provided at two positions that oppose to each other such that the through hole 42 is located therebetween. Each of the suction ports 41 is formed such that a part of outer edge portion of the cover-side side plate 40 is cut out. The suction ports 41 communicate with the suction pressure chamber 21 formed in the pump cover 20. The suction ports 41 guide the working oil that has been supplied from the suction pressure chamber 21 into the pump chambers 6.

The sliding-contact surface 40*a* of the cover-side side plate 40 has a pair of back-pressure grooves (not shown) that are formed so as to respectively oppose to the pair of back-pressure grooves 35 in the body-side side plate 30 described above and a pair of back-pressure grooves 44 that are formed so as to respectively opposed to the pair of back-pressure grooves 34 in the body-side side plate 30 described above. Each of back-pressure grooves provided in the sliding-contact surface 40*a* of the cover-side side plate 40 has a configuration similar to that of the back-pressure groove provided in the body-side side plate 30, and description thereof is omitted.

Next, operation of the vane pump 100 will be described.

As the driving shaft 1 is rotationally driven by a motive force from the driving device (not shown), such as an engine, etc., the rotor 2 is rotated in the direction shown by the arrow in FIG. 2. As the rotor 2 is rotated, the pump chambers 6 positioned in the first and second suction regions are expanded. With such a configuration, as shown by arrows in FIG. 1, the working oil in the tank 60 is sucked into the pump chambers 6 through the suction passages 61, the suction pressure chamber 21, the suction ports 41, and the suction ports 33. In addition, as the rotor 2 is rotated, the pump chambers 6 positioned in the first and second discharge regions are contracted. With such a configuration, the working oil in the pump chambers 6 is discharged to the high-pressure chamber 14 through the discharge ports 31. The working oil that has been discharged to the high-pressure chamber 14 is then supplied to the external fluid hydraulic apparatus 70 through the discharge passage 62. In the vane pump 100 according to this embodiment, while the rotor 2 completes a full rotation, each of the pump chambers 6 repeats a cycle of sucking and discharging the working oil twice.

A part of the working oil that has been discharged to the high-pressure chamber 14 is supplied to the back pressure chambers 5 through the communication holes 38 and the back-pressure grooves 34, and pushes the base-end portions 3*b* of the vanes 3 towards the inner circumference cam face 4*a*. Therefore, the vanes 3 are biased in the direction in which the vanes 3 project out from the slits 2A by a fluid pressure force from the back pressure chambers 5 pushing the base-end portions 3*b* and by a centrifugal force caused by the rotation of the rotor 2. With such a configuration, because the tip end portions 3*a* of the vanes 3 rotate while being coming into sliding contact with the inner circumference cam face 4*a* of the cam ring 4, the working oil in the pump chambers 6 is discharged from the discharge ports 31 without leaking out from between the tip end portions 3*a* of the vanes 3 and the inner circumference cam face 4*a* of the cam ring 4.

With the vane pump 100 as described above, in the first and second discharge regions, the vanes 3 are pushed towards the rotation center axis O of the rotor 2 by the inner circumference cam face 4*a* as the rotor 2 is rotated. Thus, when the rotating speed of the rotor 2 is high, there may be a case in which the vanes 3 are temporarily separated away from the inner circumference cam face 4*a* as the tip end portions 3*a* of the vanes 3 are pushed towards the rotation center axis O of the rotor 2 by the inner circumference cam face 4*a* against the back pressure and centrifugal force acting on the vanes 3.

Because small gaps are formed between the vanes 3 and the side plates 30 and 40, there may be a case in which, as the vane 3 is separated away from the inner circumference cam face 4*a*, the vane 3 is tilted so as to lean towards one of the pair of side plates 30 and 40. For example, there is a possibility that, when the vane 3 is tilted so as to lean towards the body-side side plate 30, the base-end portion 3*b* of the vane 3 falls into the back-pressure groove 34 or 35, and the base-end portion 3*b* of the fallen vane 3 is caught on an inner circumferential surface of the back-pressure groove 34 or 35.

Figure 4A:
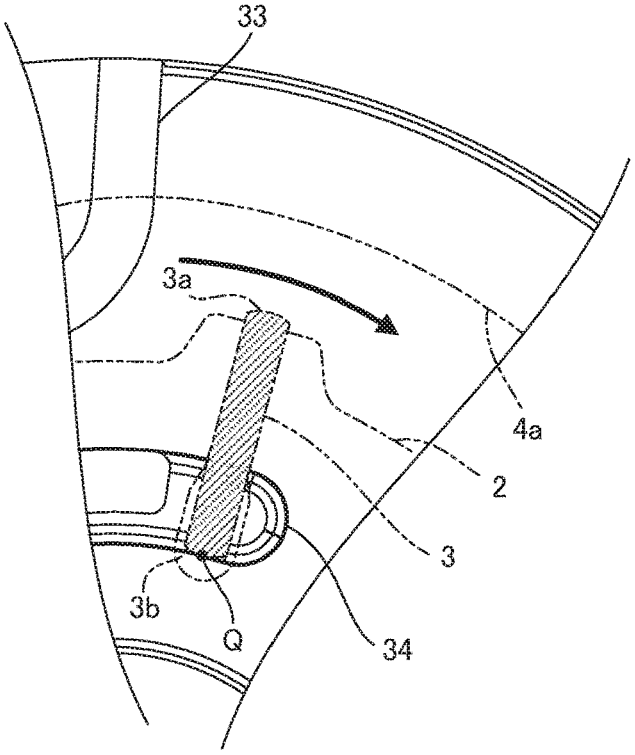
FIG. 4A is a schematic view showing movement of a vane being pushed outwards in the radial direction by a back-pressure groove formed in each of first and second suction regions, and shows a state in which the vane is guided by the inner circumferential surface of the back-pressure groove in the vicinity of an end portion.
Figure 4B:
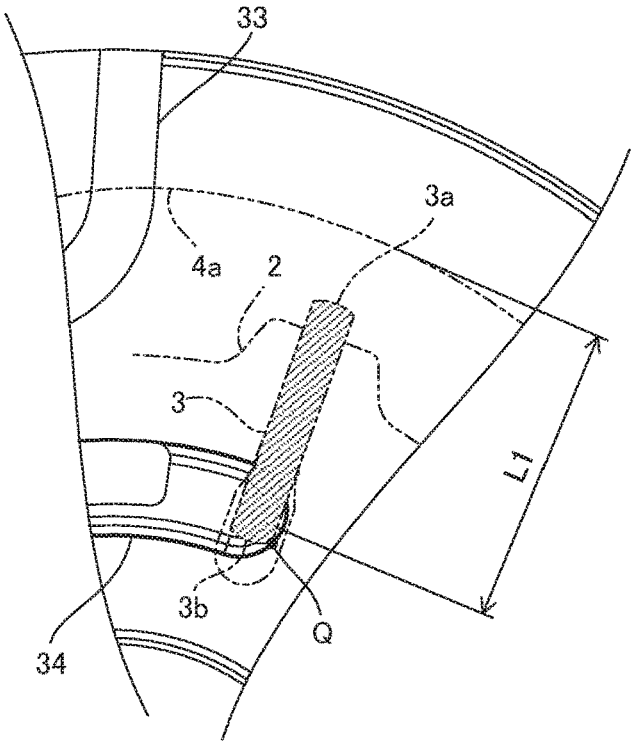
FIG. 4B is a schematic view showing the movement of the vane being pushed outwards in the radial direction by the back-pressure groove provided in each of the first and second suction regions, and shows a state in which the vane is pushed outwards in the radial direction by the inner circumferential surface of an end portion of the back-pressure groove.

As shown in FIGS. 4A and 4B, if the base-end portion 3*b* of the vane 3 is caught on the inner circumferential surface of the back-pressure groove 34 (see a point Q), the base-end portion 3*b* of the vane 3 is guided so as to move along the inner circumferential surface of the back-pressure groove 34 as the rotor 2 is rotated.

In this embodiment, in the back-pressure grooves 34 provided in the first and second suction regions, a distance (radial length) L1 from the inner circumference cam face 4*a* of the cam ring 4 to an end portion of the back-pressure groove 34 on the communication-finishing side, where the communication between the back-pressure groove 34 and the back pressure chamber 5 finishes as the rotor 2 is rotated, is sufficiently longer than the radial length of the vanes 3. Thus, even in a case in which the base-end portion 3*b* of the vane 3 falls into the back-pressure groove 34 and the vane 3 is forcedly pushed outwards in the radial direction of the rotor 2 by the back-pressure groove 34 as the rotor 2 is rotated, the tip end portion 3*a* of the vane 3 is not pressed against the inner circumference cam face 4*a*.

In contrast, in the back-pressure grooves 35 provided in the first and second discharge regions, a distance between the inner circumference cam face 4*a* and the end portion of the back-pressure groove 35 on the communication-finishing side, where the communication between the back-pressure groove 35 and the back pressure chamber 5 finishes as the rotor 2 is rotated is short. A case in which end portions of back-pressure grooves 935 provided in the first and second discharge regions are formed to have a shape similar to the shape of the end portions of the back-pressure grooves 34 as in a comparative example of the present embodiment shown in FIG. 9 will be described. In this case, in the back-pressure groove 935 shown in FIG. 9, a distance (the radial length) L2 from the inner circumference cam face 4*a* to the end portion of the back-pressure groove 935 on the communication-finishing side, where the communication between the back-pressure groove 935 and the back pressure chamber 5 finishes as the rotor 2 is rotated (a position corresponding to an finishing end P0 of a back pressure opening portion 180 in the present embodiment shown in FIG. 3) is shorter than the radial length of the vane 3. Thus, when the base-end portion 3*b* of the vane 3 falls into the back-pressure groove 935, the vane 3 is forcedly pushed outwards in the radial direction of the rotor 2 by the back-pressure groove 935 as the rotor 2 is rotated, and the tip end portions 3*a* of the vanes 3 is pressed against the inner circumference cam face 4*a*.

Thus, in this embodiment, the back-pressure groove 35 is formed such that, even when the base-end portion 3*b* of the vane 3 is guided so as to move along an inner circumferential surface of the back-pressure groove 35, the tip end portion 3*a* of the vane 3 is not pressed against the inner circumference cam face 4*a*. In the above configuration, because the back-pressure groove 35 formed in the body-side side plate 30 and the back-pressure groove (not shown) formed in the cover-side side plate 40 at the position opposing to the back-pressure grooves 35 have a similar shape, a representative detailed description will be given below on the shape of the back-pressure grooves 35 of the body-side side plate 30.

As shown in FIG. 3, the back-pressure grooves 35 have the arc-shaped back pressure opening portions 180 and substantially triangle protruding opening portions 190. Each of the protruding opening portions 190 protrudes along the rotating direction of the rotor 2 from the end portion of the back pressure opening portion 180 on the communication-finishing side, where the communication between the back pressure opening portion 180 and the back pressure chamber 5 finishes as the rotor 2 is rotated.

Figure 5A:
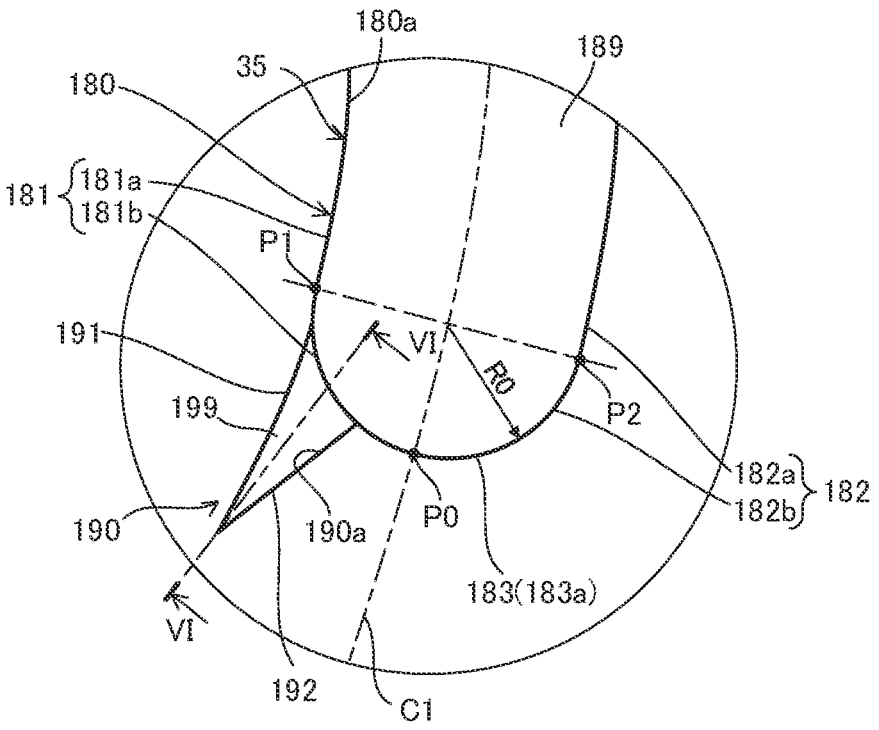
FIG. 5A is an enlarged view of a portion V in FIG. 3 and shows the end portion of the back-pressure groove according to the first embodiment of the present invention.
Figure 6:
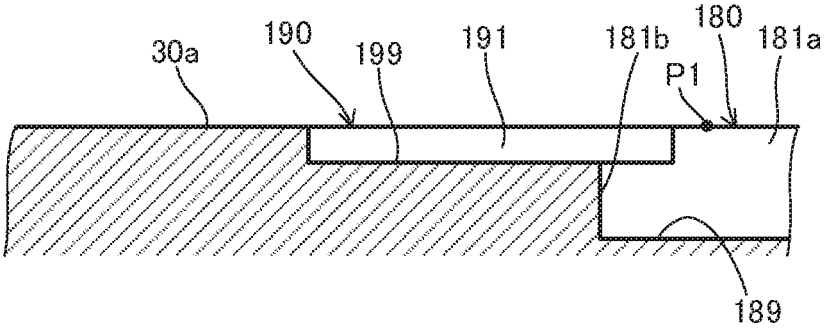
FIG. 6 is a sectional view taken along a line VI-VI in FIG. 5A.

As shown in FIGS. 5A and 6, the back pressure opening portion 180 is formed to have a groove shape, and has a bottom surface 189 and an inner circumferential surface 180*a* that is erected perpendicularity upwards from an outer circumference of the bottom surface 189. The protruding opening portion 190 is formed to have a groove shape, and has a bottom surface 199 and an inner circumferential surface 190*a* that is erected perpendicularity upwards from an outer circumference of the bottom surface 199. Because the back pressure opening portion 180 and the protruding opening portion 190 are formed to open at the sliding-contact surface 30*a*, as shown in FIG. 6, an opening edge of the back pressure opening portion 180 and an opening edge of the protruding opening portion 190 are set so as to have the same height position. On the other hand, a depth from the opening edge of the back pressure opening portion 180 to the bottom surface 189 is greater than a depth from the opening edge of the protruding opening portion 190 to the bottom surface 199. Thus, a step is formed at a connecting portion of the back pressure opening portion 180 and the protruding opening portion 190.

As described above, in this embodiment, the protruding opening portion 190 is formed such that the height dimension of the protruding opening portion 190 becomes smaller than the height dimension of the back pressure opening portion 180. Therefore, it suffices to form the shallow groove-shaped protruding opening portion 190 on the end portion of the back pressure opening portion 180 on the communication-finishing side, and therefore, it is possible to achieve reduction in the manufacturing cost.

As shown in FIG. 5A, the inner circumferential surface 180*a* of the back pressure opening portion 180 has an inner-side inner circumferential surface 181 facing radially outward of the rotor 2 and an outer-side inner circumferential surface 182 facing radially inward of the rotor 2.

As shown in FIG. 3, the one end of the inner-side inner circumferential surface 181 is connected to the one end of the outer-side inner circumferential surface 182 at a starting point X of the back pressure opening portion 180. The other end of the inner-side inner circumferential surface 181 is connected to the other end of the outer-side inner circumferential surface 182 at the finishing end P0 of the back pressure opening portion 180. The starting point X of the back pressure opening portion 180 is a position in the back pressure opening portion 180 at which the communication between the back pressure opening portion 180 and the back pressure chambers 5 begins as the rotor 2 is rotated. The finishing end P0 of the back pressure opening portion 180 is a position in the back pressure opening portion 180 at which the communication between the back pressure opening portion 180 and the back pressure chambers 5 finishes as the rotor 2 is rotated.

As shown by one-dot chain line in FIG. 5A, a center plane C1 with respect to the width (the radial length) direction of the back pressure opening portion 180 extends along the rotating direction of the rotor 2 and passes through the starting point X (see FIG. 3) and the finishing end P0.

The inner-side inner circumferential surface 181 of the back pressure opening portion 180 has an inner-side arc-shaped surface 181*a* that is formed to have an arc shape extending along the circumferential direction of the rotor 2 and an inner-side connecting surface 181*b* that extends from an end point P1 of the inner-side arc-shaped surface 181*a* to the finishing end P0 of the back pressure opening portion 180.

The outer-side inner circumferential surface 182 of the back pressure opening portion 180 has an outer-side arc-shaped surface 182*a* that is formed to have an arc shape extending along the circumferential direction of the rotor 2 and an outer-side connecting surface 182*b* that extends from an end point P2 of the outer-side arc-shaped surface 182*a* to the finishing end P0 of the back pressure opening portion 180.

The inner-side connecting surface 181*b* and the outer-side connecting surface 182*b* are each an arc-shaped surface with the radius R0 having the center on the center plane C1 inside the back pressure opening portion 180, and form a semi-arc-shaped surface 183 having a semi-arc-shape by being continuously connected. The semi-arc-shaped surface 183 shown in FIG. 5A forms the end portion of the back pressure opening portion 180 on the communication-finishing side. In the above, the semi-arc-shaped surface 183 is similarly formed also on the communication-beginning end side of the back pressure opening portion 180. In other words, the inner circumferential surface 180*a* of the back pressure opening portion 180 has the inner-side arc-shaped surface 181*a*, the outer-side arc-shaped surface 182*a*, and a pair of semi-arc-shaped surfaces 183 forming both end portions of the back pressure opening portion 180. Among the pair of semi-arc-shaped surfaces 183, the semi-arc-shaped surface 183 forming the end portion of the back pressure opening portion 180 on the communication-finishing side is referred to as an finishing-end-side semi-arc-shaped surface 183*a*.

The protruding opening portion 190 is provided on the inner side of the center plane C1 of the back pressure opening portion 180 in the radial direction of the rotor 2. In this embodiment, a base-end portion and a tip end portion of the protruding opening portion 190 are each provided on the inner side of the center plane C1 of the back pressure opening portion 180 in the radial direction of the rotor 2. In other words, the base-end portion and the tip end portion of the protruding opening portion 190 are each set at the position closer to the inner-side arc-shaped surface 181*a* than the outer-side arc-shaped surface 182*a* of the back pressure opening portion 180.

The protruding opening portion 190 has an inner-side inner circumferential surface 191 facing radially outward of the rotor 2 and an outer-side inner circumferential surface 192 facing radially inward of the rotor 2. A base end of the inner-side inner circumferential surface 191 and a base end of the outer-side inner circumferential surface 192 are each connected to the inner-side connecting surface 181*b* of the back pressure opening portion 180 on the inner side of the center plane C1 of the back pressure opening portion 180 in the radial direction of the rotor 2. In other words, the connecting portions of the protruding opening portion 190 and the back pressure opening portion 180 are set so as to be positioned on the inner side of the center plane C1 of the back pressure opening portion 180 in the radial direction of the rotor 2.

The inner-side inner circumferential surface 181 and the outer-side inner circumferential surface 182 of the back pressure opening portion 180, and the inner-side inner circumferential surface 191 and the outer-side inner circumferential surface 192 of the protruding opening portion 190 are provided so as to be continuous with the sliding-contact surface 30*a* and forms the inner circumferential surface of the back-pressure groove 35.

Figure 5B:
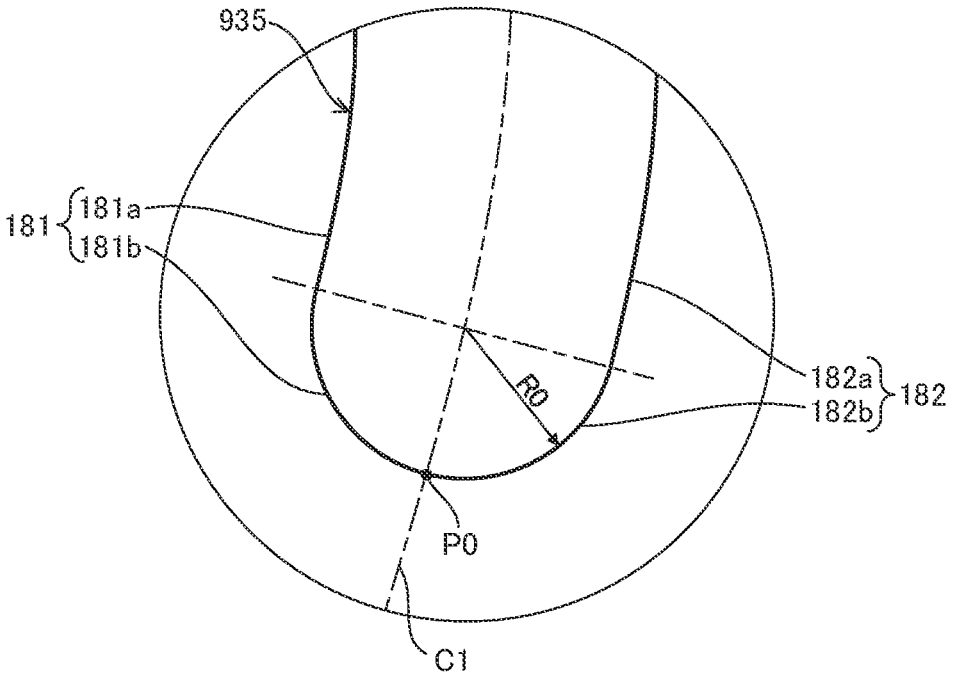
PRIOR ART FIG. 5B
FIG. 5B is an enlarged view of the back-pressure groove according to a comparative example of the present embodiment.

Operational advantages of the present embodiment achieved by employing the above-described configuration will be specifically described in comparison with a comparative example of the present embodiment shown in FIG. 5B.

As shown in FIG. 5B, the back-pressure groove 935 according to the comparative example of the present embodiment is not provided with the protruding opening portion 190 (see FIG. 5A).

Figure 7:
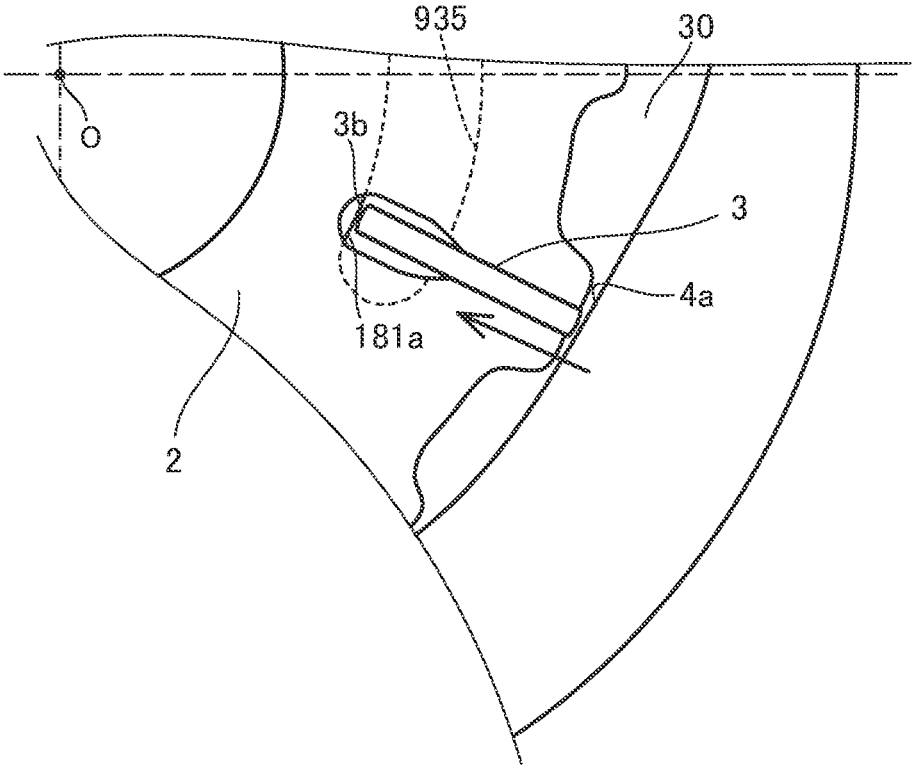
PRIOR ART FIG.7
FIG. 7 is a view for explaining motion of the vane in the vane pump according to the comparative example of the present embodiment, and shows a state in which the vane is separated away from an inner circumference cam face.
Figure 8:
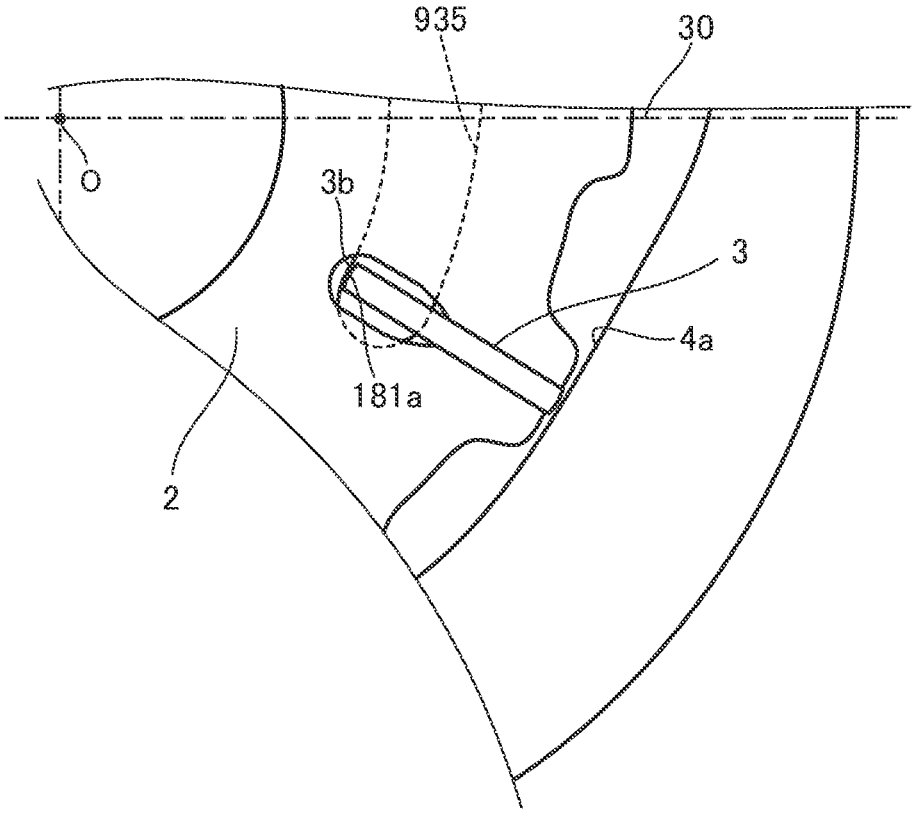
PRIOR ART FIG.8
FIG. 8 is a view for explaining the motion of the vane in the vane pump according to the comparative example of the present embodiment, and shows a state in which the vane is caught on an inner-side inner circumferential surface of the back-pressure groove.
Figure 9:
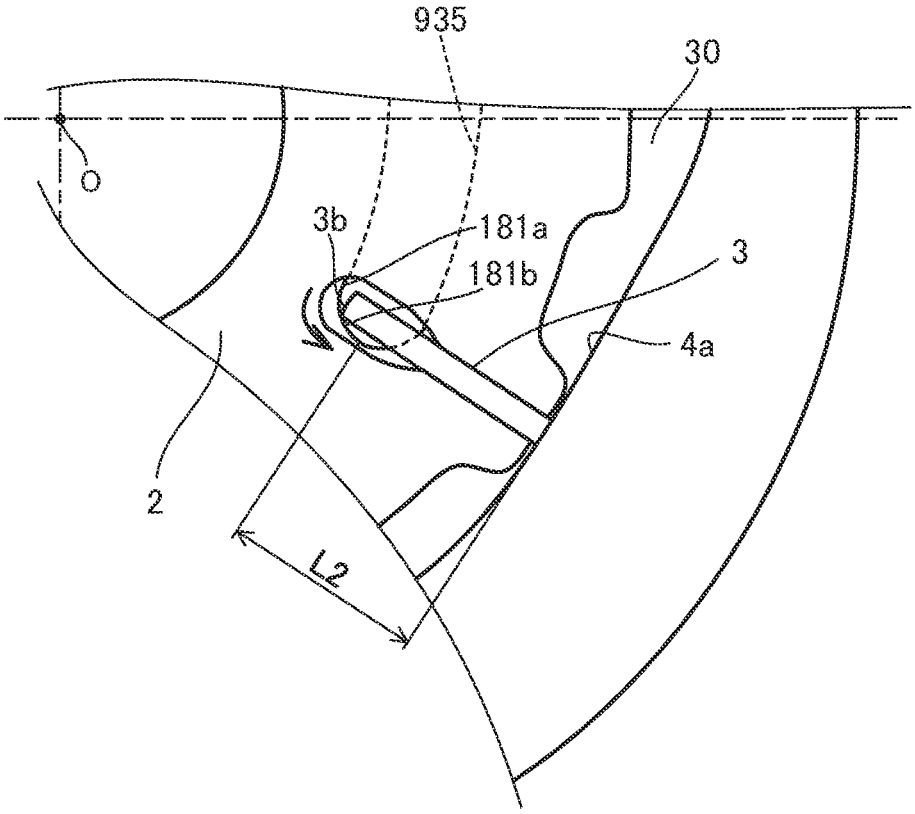
PRIOR ART FIG.9
FIG. 9 is a view for explaining the motion of the vane in the vane pump according to the comparative example of the present embodiment, and shows a state in which the vane is clamped between the inner-side inner circumferential surface of the back-pressure groove and the inner circumference cam face.

The motion of the vanes 3 in the vane pump according to the comparative example of the present embodiment will be described with reference to FIGS. 7 to 9. When the vane pump is operated, while the rotor 2 is rotated, each of the vanes 3 is normally in sliding contact with the inner circumference cam face 4*a* (see FIG. 2). However, as shown by an arrow in FIG. 7, the vane 3 may temporarily be separated away from the inner circumference cam face 4*a* as the rotor 2 is rotated. In FIGS. 7 to 9, the description will focus on the separated vane 3, and the motion thereof will be described. In FIGS. 7 to 9, the configuration related to the motion of the separated vane 3 are shown, and illustration of other configuration is appropriately omitted.

The vane 3 that has been separated is tilted so as to lean towards the body-side side plate 30, and then, as shown in FIG. 8, the base-end portion 3*b* of the vane 3 falls into the back-pressure groove 935 and is caught on the inner-side arc-shaped surface 181*a* of the back-pressure groove 935. As the rotor 2 is rotated in this state, the base-end portion 3*b* of the vane 3 is guided so as to move along the inner-side arc-shaped surface 181*a* with the rotation of the rotor 2.

As shown by an arrow in FIG. 9, as the rotor 2 is rotated, the base-end portion 3*b* of the vane 3 is moved from the inner-side arc-shaped surface 181*a* to the inner-side connecting surface 181*b* and is guided so as to move along the inner-side connecting surface 181*b*.

The inner-side connecting surface 181*b* is formed to have an arc-shape so as to be curved outward in the radial direction in the rotating direction of the rotor 2. Thus, as the rotor 2 is rotated, the base-end portion 3*b* of the vane 3 is guided so as to move along the inner-side connecting surface 181*b*, and the vane 3 is forcedly pushed outwards in the radial direction by the inner-side connecting surface 181*b*.

As the vane 3 is forcedly pushed outwards in the radial direction by a physical contact between the base-end portion 3*b* of the vane 3 and the back-pressure groove 935, the tip end portion 3*a* of the vane 3 is pressed against the inner circumference cam face 4*a*. As a result, the rotor 2 is moved in the circumferential direction in a state in which the vane 3 is clamped between the inner-side inner circumferential surface 181 of the back-pressure groove 935 and the inner circumference cam face 4*a* of the cam ring 4, temporarily, and therefore, the inner circumference cam face 4*a*, and the tip end portion 3*a* and the base-end portion 3*b* of the vane 3 are worn out.

In contrast, in the present embodiment, after the vane 3 has fallen into the back-pressure groove 35, the present invention is operated in a manner described below.

Similarly to the comparative example, the vane 3 that has fallen into the back-pressure groove 35 is caught on the inner-side arc-shaped surface 181*a* of the back-pressure groove 35. As the rotor 2 is rotated in this state, the base-end portion 3*b* of the vane 3 is guided so as to move along the inner-side arc-shaped surface 181*a* with the rotation of the rotor 2.

However, in this embodiment, as shown in FIG. 5A, the inner-side inner circumferential surface 191 of the protruding opening portion 190 is provided so as to be continuous with the inner-side inner circumferential surface 181 of the back pressure opening portion 180. Thus, the base-end portion 3*b* of the vane 3 is guided so as to move along the inner-side arc-shaped surface 181*a* as the rotor 2 is rotated, passes through the end point P1, and thereafter, guided to the inner-side inner circumferential surface 191 of the protruding opening portion 190. In other words, in this embodiment, as shown in FIG. 10, the base-end portion 3*b* of the vane 3 escapes from the inner-side inner circumferential surface 181 of the back pressure opening portion 180 to the inner-side inner circumferential surface 191 of the protruding opening portion 190 and is guided so as to move along the inner-side inner circumferential surface 191, and therefore, the vane 3 is prevented from being forcedly pushed outwards in the radial direction of the rotor 2.

Figure 10:
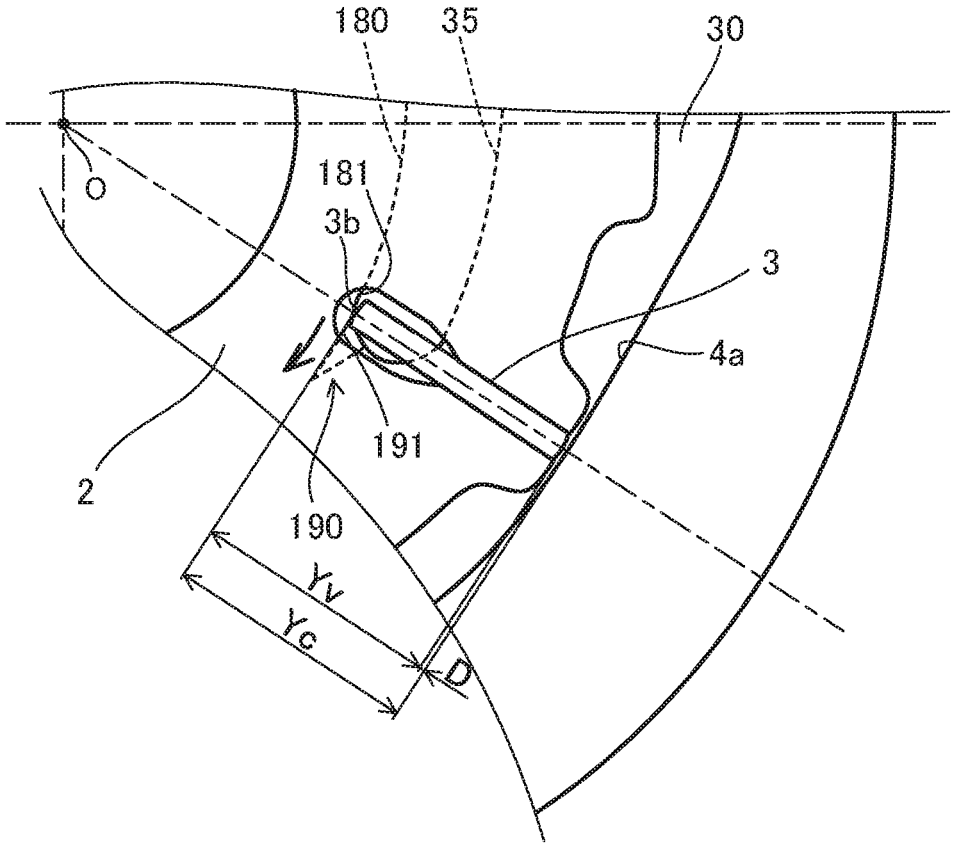
FIG. 10 is a view for explaining the motion of the vane in the vane pump according to the first embodiment, and shows a state in which the vane is guided from an inner-side inner circumferential surface of a back pressure opening portion to an inner-side inner circumferential surface of a protruding opening portion.

In this embodiment, as shown in FIG. 10, the protruding opening portion 190 is formed such that a radial length Yc from the inner-side inner circumferential surface 191 of the protruding opening portion 190 to the inner circumference cam face 4*a* becomes longer than a radial length Yv of the vane 3. Thus, in a state in which the inner-side inner circumferential surface 191 and the base-end portion 3*b* of the vane 3 are in contact with each other, a small gap D is formed between the tip end portion 3*a* of the vane 3 and the inner circumference cam face 4*a*. In other words, the contact between the tip end portion 3*a* of the vane 3 and the inner circumference cam face 4*a* is avoided while the base-end portion 3*b* of the vane 3 is being guided by the inner-side inner circumferential surface 191 of the protruding opening portion 190.

Especially, in this embodiment, the tip end portion of the protruding opening portion 190 is set at the position closer to the inner-side inner circumferential surface 181 than the outer-side inner circumferential surface 182 of the back pressure opening portion 180, and the tip end portion of the protruding opening portion 190 is arranged towards the vicinity of the inner-side inner circumferential surface 181 of the back pressure opening portion 180. Thus, it is possible to ensure a sufficient distance between the inner-side inner circumferential surface 181 of the protruding opening portion 190 and the inner circumference cam face 4*a* of the cam ring 4. As a result, it is possible to suppress an amount of the vane 3 being pushed outwards in the radial direction of the rotor 2 with the rotation of the rotor 2 by the inner-side inner circumferential surface 191 of the protruding opening portion 190.

According to the above-described first embodiment, operational advantages shown below can be afforded.

In the vane pump 100 according to this embodiment, the protruding opening portion 190 is provided so as to protrude out along the rotating direction of the rotor 2 from the finishing-end-side semi-arc-shaped surface 183*a* that is the end portion of the back pressure opening portion 180 on the communication-finishing side. The inner-side inner circumferential surface 191 of the protruding opening portion 190 is connected to the inner-side inner circumferential surface 181 of the back pressure opening portion 180. Thus, the base-end portion 3*b* of the vane 3 that has fallen into the back pressure opening portion 180 is guided to the inner-side inner circumferential surface 191 of the protruding opening portion 190 from the inner-side inner circumferential surface 181 of the back pressure opening portion 180. With such a configuration, the vane 3 is prevented from being forcedly pushed outwards in the radial direction by the inner-side connecting surface 181*b* of the back pressure opening portion 180. Therefore, according to the present embodiment, it is possible to prevent the wear of the inner circumference cam face 4*a*, the tip end portion 3*a* and the base-end portion 3*b* of the vane 3 that is caused when the vane 3 is clamped between the inner-side inner circumferential surface 181 of the back-pressure groove 35 and the inner circumference cam face 4*a* of the cam ring 4.

Second Embodiment

The vane pump 100 according to a second embodiment of the present invention will be described with reference to FIGS. 11 and 12A. In the following, differences from the above-described first embodiment will be mainly described, and in the figures, components that are the same as or correspond to the components described in the above-mentioned first embodiment are assigned the same reference numerals and description thereof will be omitted.

In the first embodiment, the protruding opening portion 190 has a substantially triangle shape. In contrast, in this second embodiment, a protruding opening portion 290 has a substantially oval shape. A back-pressure groove 235 according to the second embodiment has the back pressure opening portion 180 and the protruding opening portion 290 that protrudes out in the circumferential direction from the end portion of the back pressure opening portion 180.

Figure 11:
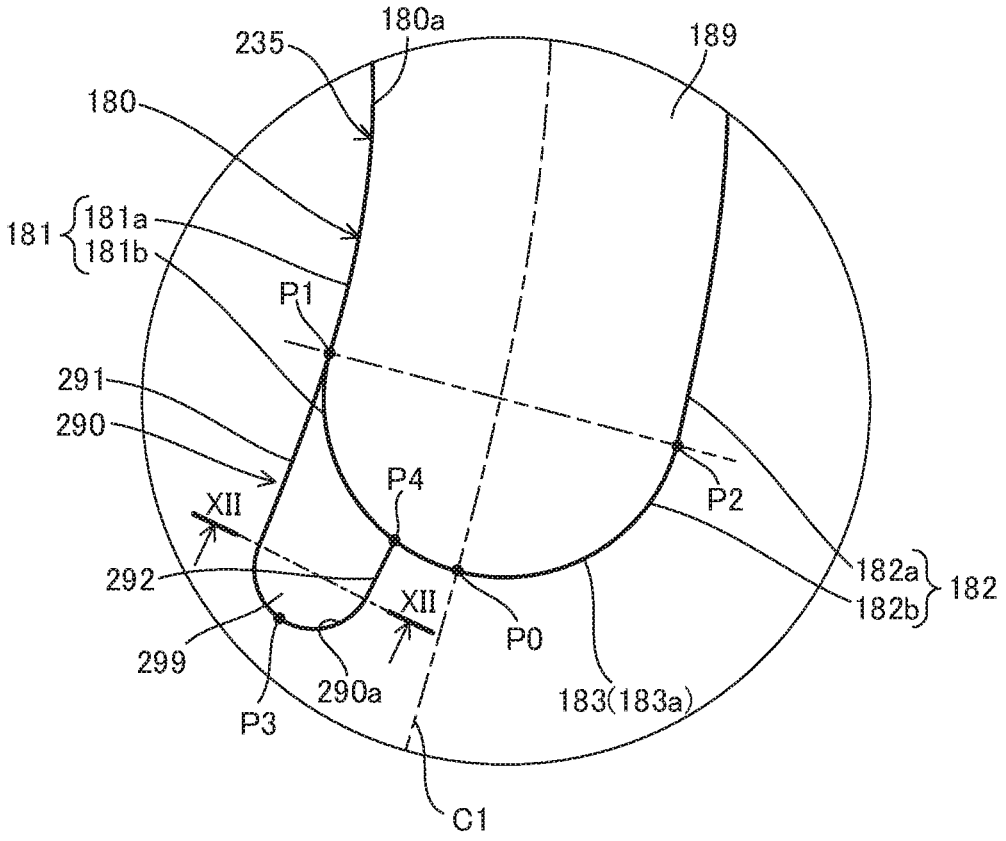
FIG. 11 is an enlarged view of the back-pressure groove according to a second embodiment of the present invention.

As shown in FIG. 11, the protruding opening portion 290 is formed so as to protrude out along the rotating direction of the rotor 2 from the finishing-end-side semi-arc-shaped surface 183*a* forming the end portion of the back pressure opening portion 180 on the communication-finishing side.

Figure 12A:
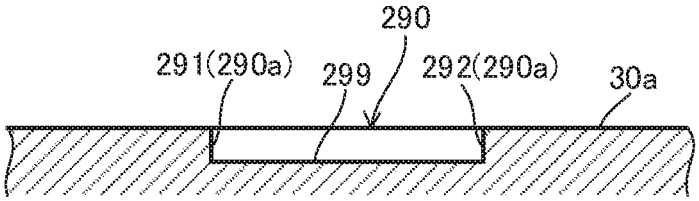
FIG. 12A is a sectional view taken along a line XII-XII in FIG. 11.

As shown in FIG. 12A, the protruding opening portion 290 has a flat bottom surface 299 and an inner circumferential surface 290*a* that is erected perpendicularity upwards from the outer circumference of the bottom surface 299, and the protruding opening portion 290 has a rectangular cross-section.

The inner circumferential surface 290*a* of the protruding opening portion 290 has an inner-side inner circumferential surface 291 that faces radially outward of the rotor 2 and an outer-side inner circumferential surface 292 that faces radially inward of the rotor 2. As illustrated in the figure, the inner-side inner circumferential surface 291 is an inner circumferential surface that extends from a connected point with the inner-side arc-shaped surface 181*a* (the end point P1) to a tip end of the protruding opening portion 290 (an end point P3). As illustrated in the figure, the outer-side inner circumferential surface 292 is an inner circumferential surface that extends from a connected point with the inner-side connecting surface 181*b* (an end point P4) to the tip end of the protruding opening portion 290 (the end point P3).

The inner-side inner circumferential surface 291 of the protruding opening portion 290 is formed so as to be continuous with the inner-side arc-shaped surface 181*a* of the back pressure opening portion 180. The protruding opening portion 290 is formed such that the radial length from the inner-side inner circumferential surface 291 to the inner circumference cam face 4*a* becomes longer than the radial length of the vane 3. In other words, the protruding opening portion 290 is formed such that the dimension from the tip end of the protruding opening portion 290 (the end point P3) to the inner circumference cam face 4*a* in the radial direction becomes larger than the dimension of the vanes 3 in the radial direction.

According to the second embodiment as described above, in addition to operational advantages similar to those of the above-described first embodiment, following advantages are afforded.

Because the inner-side inner circumferential surface 291 of the protruding opening portion 290 is formed so as to be continuous with the inner-side arc-shaped surface 181*a* of the back pressure opening portion 180, it is possible to allow the base-end portion 3*b* of the vane 3 in sliding contact with the back pressure opening portion 180 to move more smoothly into the protruding opening portion 290 as the rotor 2 is rotated.

First Modification of Second Embodiment

Figure 12B:
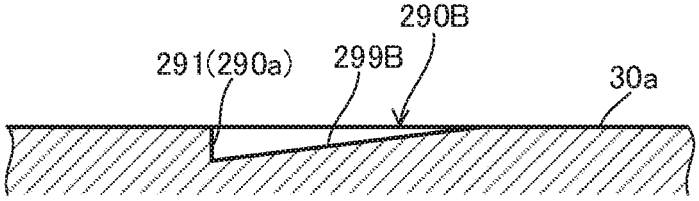
FIG. 12B is a sectional view of the back-pressure groove according to a first modification of the second embodiment.

In the above-described second embodiment, although a description is given of an example in which the protruding opening portion 290 is formed to have the rectangular cross-section, the present invention is not limited thereto. For example, as shown in FIG. 12B, a protruding opening portion 290B may be formed to have a triangular cross-section. In this case, a bottom surface 299B is inclined relative to the sliding-contact surface 30*a* and extends to the sliding-contact surface 30*a* from a lower end of the inner-side inner circumferential surface 291. Thus, in this modification, the outer-side inner circumferential surface 292 is not provided in the protruding opening portion 290B (see FIG. 12A). Also with such a modification, operational advantages similar to those of the above-described second embodiment are afforded.

Second Modification of Second Embodiment

Figure 12C:
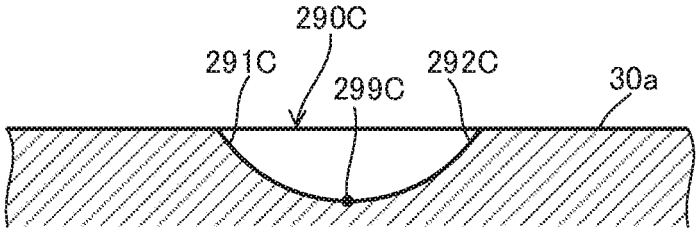
FIG. 12C is a sectional view of the back-pressure groove according to a second modification of the second embodiment.

For example, as shown in FIG. 12C, a protruding opening portion 290C may be formed to have a semicircular cross-section. In this case, an inner-side inner circumferential surface 291C of the protruding opening portion 290C is connected to the outer-side inner circumferential surface 292 at a bottom portion 299C of the protruding opening portion 290C. Also with such a modification, operational advantages similar to those of the above-described second embodiment are afforded.

Third Embodiment

The vane pump 100 according to a third embodiment of the present invention will be described with reference to FIGS. 13 to 15. In the following, differences from the above-described first embodiment will be mainly described, and in the figures, components that are the same as or correspond to the components described in the above-mentioned first embodiment are assigned the same reference numerals and description thereof will be omitted.

In the first embodiment, a description is given of an example in which the depth of the protruding opening portions 190 and the depth of the back pressure opening portion 180 are different, and the step is formed therebetween. In contrast, in the third embodiment, a depth of a protruding opening portion 390 is set so as to be equal to a depth of a back pressure opening portion 380.

A back-pressure groove 335 according to the third embodiment has the back pressure opening portion 380 and the protruding opening portion 390 that protrudes along the rotating direction of the rotor 2 from the end portion of the back pressure opening portion 380 on the communication-finishing side, where the communication between the back pressure opening portion 380 and the back pressure chamber 5 finishes as the rotor 2 is rotated.

Figure 13:
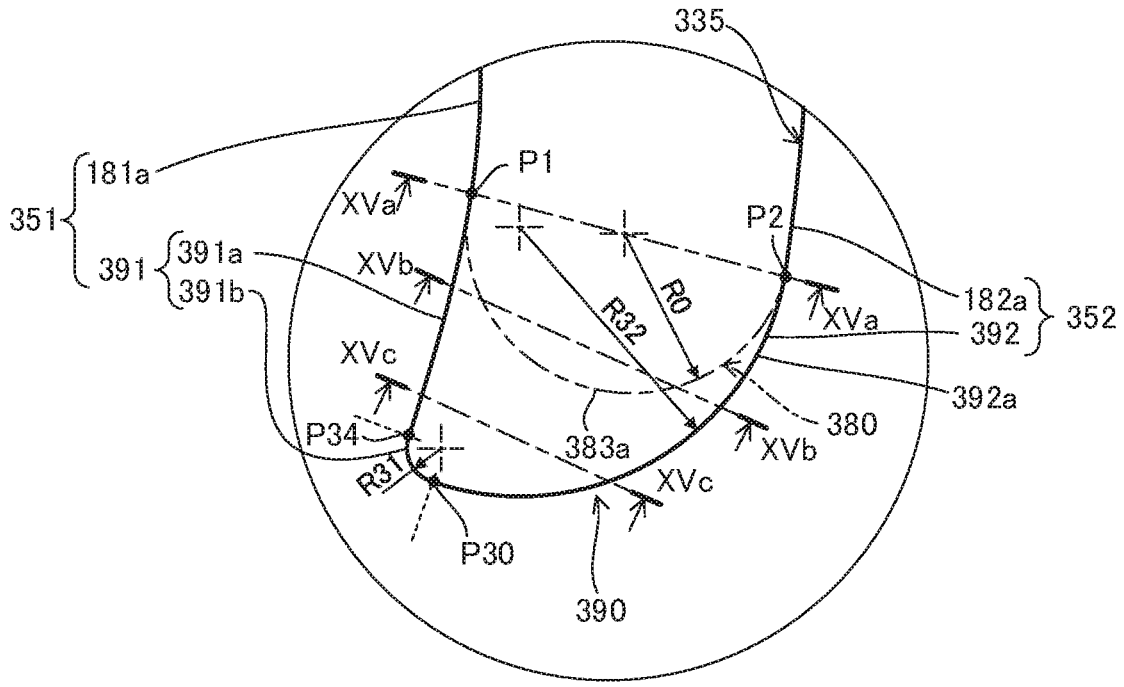
FIG. 13 is an enlarged view of the back-pressure groove according to a third embodiment of the present invention.

As shown by a two-dot chain line in FIG. 13, the back pressure opening portion 380 according to the third embodiment has the same shape as the back pressure opening portion 180 described in the first embodiment. The protruding opening portion 390 has a base end inner-side arc-shaped surface 391*a*, an outer-side arc-shaped surface 392, and a tip-end inner-side arc-shaped surface 391*b*. The base end inner-side arc-shaped surface 391*a* serving as a first arc-shaped surface extends from the inner-side arc-shaped surface 181*a* of the back pressure opening portion 380 so as to be continuous therewith. The outer-side arc-shaped surface 392 serving as a second arc-shaped surface extends from the outer-side arc-shaped surface 182*a* of the back pressure opening portion 380 so as to be continuous therewith. The tip-end inner-side arc-shaped surface 391*b* serving as a third arc-shaped surface connects the base end inner-side arc-shaped surface 391*a* and the outer-side arc-shaped surface 392.

The inner-side arc-shaped surface 181*a* and the outer-side arc-shaped surface 182*a* of the back pressure opening portion 380, and the base end inner-side arc-shaped surface 391*a* of the protruding opening portion 390 are formed to have an arc shape centered at the rotation center axis O of the rotor 2. A radius of the base end inner-side arc-shaped surface 391*a* is equal to the radius of the inner-side arc-shaped surface 181*a*.

The outer-side arc-shaped surface 392 of the protruding opening portion 390 is formed to have an arc shape having its center at the inner side of the outer-side arc-shaped surface 182*a* of the back pressure opening portion 380 in the radial direction of the rotor 2. In this embodiment, the outer-side arc-shaped surface 392 is an arc-shaped surface with a radius R32 having its center at the inner side of the back-pressure groove 335.

The tip-end inner-side arc-shaped surface 391*b* of the protruding opening portion 390 is formed to have an arc shape with a radius R31 having its center at the inner side of the protruding opening portion 390.

A tip end portion of the protruding opening portion 390 is set at the position closer to the inner-side arc-shaped surface 181*a* forming an inner-side inner circumferential surface of the back pressure opening portion 380 than the outer-side arc-shaped surface 182*a* forming an outer-side inner circumferential surface of the back pressure opening portion 380. Thus, the radius R31 of the tip-end inner-side arc-shaped surface 391*b* of the protruding opening portion 390 is smaller than the radius R32 of the outer-side arc-shaped surface 392 of the protruding opening portion 390 (R31<R32). In the above, the radius R31 is smaller than the radius R0 of an finishing-end-side semi-arc-shaped surface 383*a* of the back pressure opening portion 380, and the radius R32 is larger than the radius R0 (R31<R0<R32).

The description will focus on the back-pressure groove 335 formed by the back pressure opening portion 380 and the protruding opening portion 390, and the shape thereof will be described. The back-pressure groove 335 has an inner-side inner circumferential surface 351 facing radially outward of the rotor 2 and an outer-side inner circumferential surface 352 facing radially inward of the rotor 2. The back-pressure groove 335 has the starting point X and an finishing end P30, and the finishing end P30 is a communication-finishing end of the back-pressure groove 335, where the communication between the back-pressure groove 335 and the back pressure chamber 5 finishes as the rotor 2 is rotated.

The one end of the inner-side inner circumferential surface 351 and the one end of the outer-side inner circumferential surface 352 are connected at the starting point X, and the other end of the inner-side inner circumferential surface 351 and the other end of the outer-side inner circumferential surface 352 are connected at the finishing end P30. The inner-side inner circumferential surface 351 and the outer-side inner circumferential surface 352 are provided so as to be continuous with the sliding-contact surface 30*a* and form an inner circumferential surface of the back-pressure groove 335.

The inner-side inner circumferential surface 351 of the back-pressure groove 335 has the inner-side arc-shaped surface 181*a* that is formed to have an arc shape extending along the circumferential direction of the rotor 2 and an inner-side inner circumferential surface 391 that extends from the end point P1 of the inner-side arc-shaped surface 181*a* to the finishing end P30 of the back-pressure groove 335. The inner-side inner circumferential surface 391 is formed by the base end inner-side arc-shaped surface 391*a* and the tip-end inner-side arc-shaped surface 391*b* that is connected to the base end inner-side arc-shaped surface 391*a* at a connected point P34.

The outer-side inner circumferential surface 352 of the back-pressure groove 335 has the outer-side arc-shaped surface 182*a* that is formed to have an arc shape extending along the circumferential direction of the rotor 2 and the outer-side arc-shaped surface 392 that extends from the end point P2 of the outer-side arc-shaped surface 182*a* to the finishing end P30 of the back-pressure groove 335.

In the third embodiment, the base-end portion 3*b* of the vane 3 that has fallen into the back-pressure groove 335 is moved from the inner-side arc-shaped surface 181*a* to the inner-side inner circumferential surface 391 of the protruding opening portion 390.

In the above, when the base-end portion 3*b* of the vane 3 is moved from the base end inner-side arc-shaped surface 391*a* to the tip-end inner-side arc-shaped surface 391*b*, the vane 3 is slightly pushed outwards in the radial direction by the tip-end inner-side arc-shaped surface 391*b*. In order to avoid it, this embodiment has a configuration in which the tilt of the vane 3 is corrected before the base-end portion 3*b* of the vane 3 moves from the base end inner-side arc-shaped surface 391*a* to the tip-end inner-side arc-shaped surface 391*b*.

As shown in FIG. 13, an outer-side opening edge 392*a* of the protruding opening portion 390, which is an edge of the outer-side arc-shaped surface 392 (see FIG. 15A), is formed so as to gradually approach the rotation center axis O of the rotor 2 as it extends from the end point P2 to the tip end portion of the protruding opening portion 390. The outer-side opening edge 392*a* of the protruding opening portion 390 has a function of correcting the tilt of the vane 3 by coming into contact with the vane 3 that has tilted as the base-end portion 3*b* of the vane 3 falls into the back pressure opening portion 380.

Figure 15A:
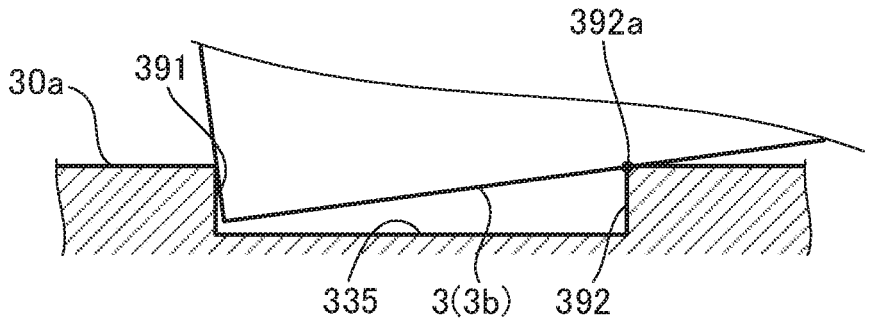
FIG. 15A is a schematic view of a cross-section of the back-pressure groove taken along a line XVa-XVa in FIG. 13.
Figure 15B:
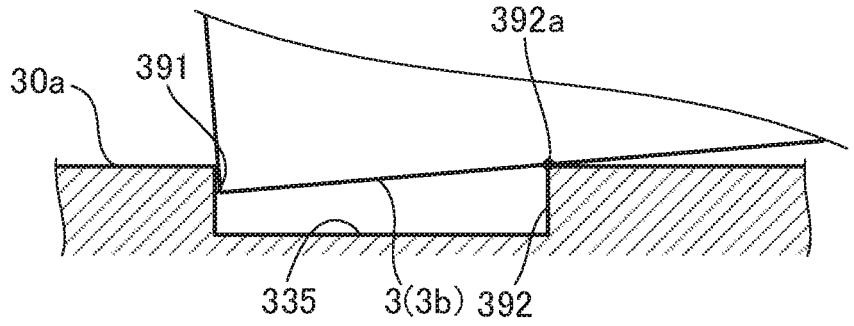
FIG. 15B is a schematic view of a cross-section of the back-pressure groove taken along a line XVb-XVb in FIG. 13.
Figure 15C:
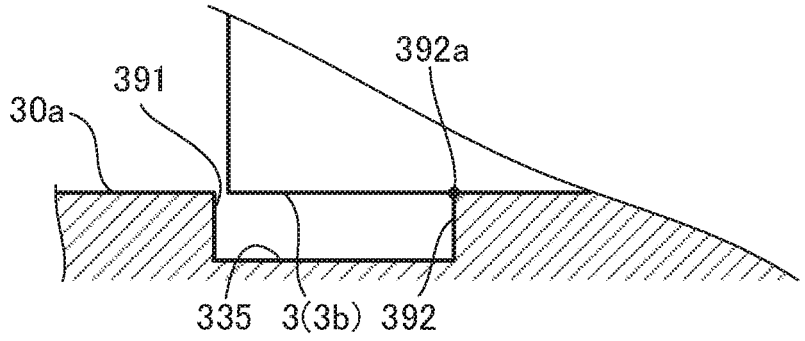
FIG. 15C is a schematic view of a cross-section of the back-pressure groove taken along a line XVc-XVc in FIG. 13.

FIGS. 15A, 15B, and 15C are schematic sectional views of a state in which the tilt of the vane 3 that has fallen into the back-pressure groove 335 is being corrected.

As shown in FIG. 15A, as the vane 3 falls into the back-pressure groove 335, the base-end portion 3*b* of the vane 3 that has tilted comes into contact with the outer-side opening edge 392*a* that is an upper end of the outer-side arc-shaped surface 392 in FIG. 15A. Thus, as shown in FIG. 15B, as the vane 3 is moved in the circumferential direction as the rotor 2 is rotated, the base-end portion 3*b* is gradually lifted up by the outer-side opening edge 392*a*, and then, as shown in FIG. 15C, the tilt of the vane 3 is corrected.

As described above, in this third embodiment, after the base-end portion 3*b* has escaped into the protruding opening portion 390, the tilt of the vane 3 is corrected before the base-end portion 3*b* reaches the tip-end inner-side arc-shaped surface 391*b*. Thus, in this third embodiment, the tip-end inner-side arc-shaped surface 391*b* can be formed such that the distance (the radial length) between a predetermined position of the tip-end inner-side arc-shaped surface 391*b* and the inner circumference cam face 4*a* becomes shorter than the radial length of the vane 3.

In other words, in this third embodiment, it suffices to form the protruding opening portion 390 such that, when the base-end portion 3*b* of the vane 3 has fallen into the back-pressure groove 335, the radial length Yc becomes longer than the radial length Yv of the vane 3. The radial length Yc is the length from the base end inner-side arc-shaped surface 391*a* to the inner circumference cam face 4*a* that forms a path through which the base-end portion 3*b* slides.

Figure 14:
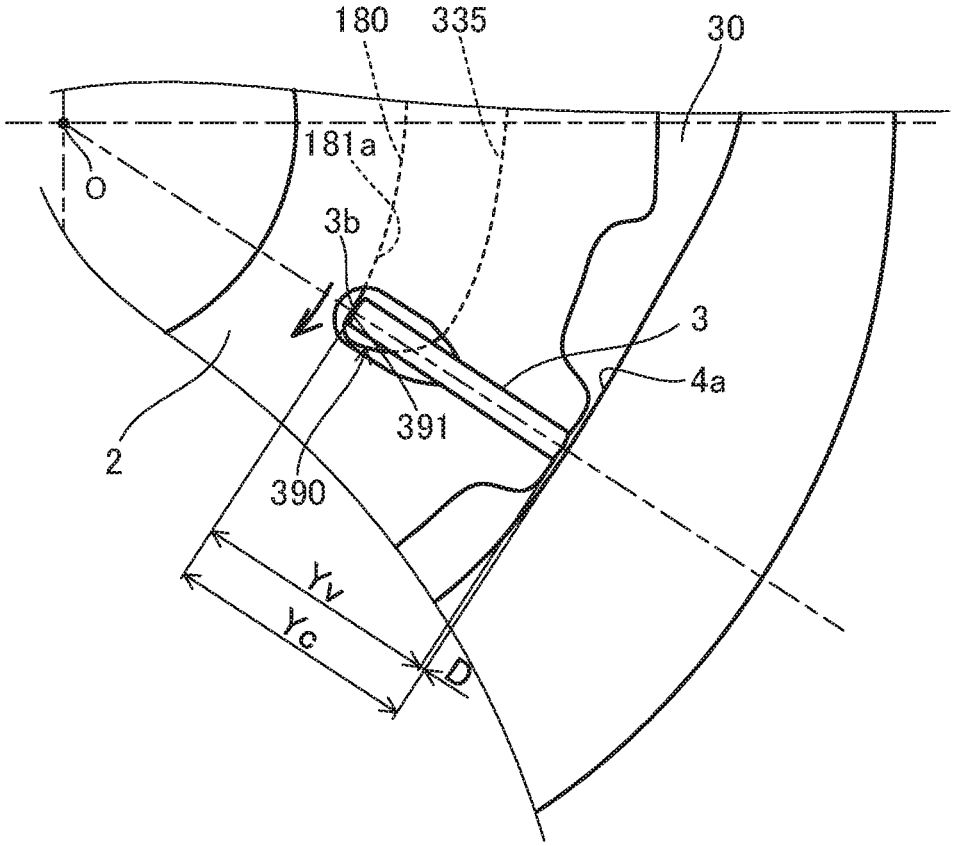
FIG. 14 is a view for explaining the motion of the vane in the vane pump according to a third embodiment, and shows a state in which the vane is guided from the inner-side inner circumferential surface of the back pressure opening portion to the inner-side inner circumferential surface of the protruding opening portion.

As shown in FIG. 14, in this third embodiment, in a state in which the base end inner-side arc-shaped surface 391*a* of the protruding opening portion 390 and the base-end portion 3*b* of the vane 3 are in contact, the small gap D is formed between the tip end portion 3*a* of the vane 3 and the inner circumference cam face 4*a*.

Therefore, in the third embodiment, similarly to the first embodiment, the vane 3 that has fallen into the back-pressure groove 335 is prevented from being clamped between the back-pressure groove 335 and the inner circumference cam face 4*a*, and therefore, the wear of the inner circumference cam face 4*a* is prevented.

As described above, the radius R31 of the tip-end inner-side arc-shaped surface 391*b* is smaller than the radius R0 of the finishing-end-side semi-arc-shaped surface 383*a* of the back pressure opening portion 380 (R31<R0).

Thus, even if the base-end portion 3*b* of the vane 3 comes into sliding contact with the tip-end inner-side arc-shaped surface 391*b*, the amount of the vane 3 being pushed outwards in the radial direction (a moved distance in the radial direction) by the tip-end inner-side arc-shaped surface 391*b* is suppressed to a lesser extent compared with that in the above-described comparative example of the present embodiment (see FIG. 5B, and FIGS. 7 to 9).

According to the third embodiment as described above, in addition to operational advantages similar to those of the above-described first embodiment, following operational advantages are afforded.

As the rotor 2 is rotated, the base-end portion 3*b* of the vane 3 is gradually lifted up by the outer-side opening edge 392*a* of the protruding opening portion 390, and it is possible to correct the tilt of the vane 3. With such a configuration, it is possible to ensure a certain degree of freedom for the shape of the tip end portion of the protruding opening portion 390.

In addition, because a step is not formed between the back pressure opening portion 380 and the protruding opening portion 390, it is possible to achieve reduction in the manufacturing cost by forming the back pressure opening portion 380 and the protruding opening portion 390 at the same time.

Following modifications are also within the scope of the present invention, and it is also possible to combine the configurations shown in the modifications with the configurations described in the above-described embodiments, to combine the configurations described in the above-described different embodiments, and to combine the configurations described in the following different modifications.

<First Modification>

Figure 16A:
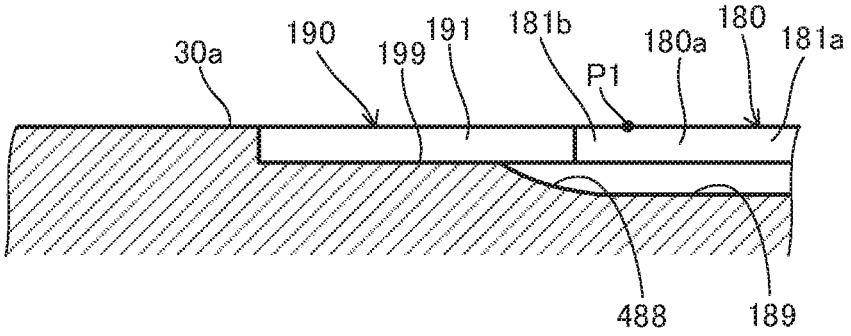
FIG. 16A is a schematic view of a cross-section of the back-pressure groove according to a modification of the present embodiment.

In the first embodiment, although a description is given of an example in which the inner circumferential surface 180*a* of the back pressure opening portion 180 is erected perpendicularity upwards from the outer circumference of the bottom surface 189, the present invention is not limited thereto. As shown in FIG. 16A, a curved surface portion 488 may be provided on the outer circumference of the bottom surface 189 of the back pressure opening portion 180, and the bottom surface 189 and the inner circumferential surface 180*a* may be connected via the curved surface portion 488.

<Second Modification>

Figure 16B:
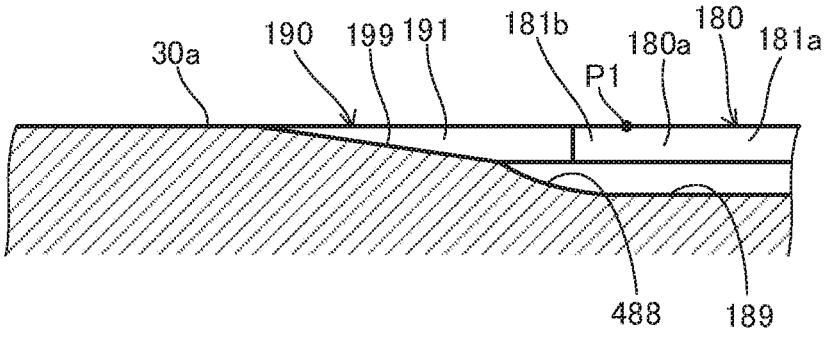
FIG. 16B is a schematic view of a cross-section of the back-pressure groove according to another modification of the present embodiment.

In the first embodiment, although a description is given of an example in which the protruding opening portion 190 is formed so as to have a uniform depth (height) from the tip end portion of the protruding opening portion 190 to the base-end portion thereof, which is the connecting portion between the protruding opening portion 190 and the back pressure opening portion 180, the present invention is not limited thereto. As shown in FIG. 16B, the protruding opening portion 190 may be formed such that the depth of the protruding opening portion 190 is gradually decreased from the base-end portion to the tip end portion of the protruding opening portion 190. With such a configuration, the tilt of the vane 3 that has been guided to the protruding opening portion 190 is gradually corrected as the rotor 2 is rotated, and therefore, it is possible to smoothly remove the base-end portion 3*b* of the vane 3 from the protruding opening portion 190.

<Third Modification>

In the above-mentioned embodiment, although a description is given of an example in which the plurality of back-pressure grooves 34, 35, and 44 are provided in both of the body-side side plate 30 and the cover-side side plate 40, the present invention is not limited thereto. The back-pressure groove may be provided in at least one of the body-side side plate 30 and the cover-side side plate 40.

<Fourth Modification>

In the above-described first embodiment, although a description is given of an example in which the protruding opening portions 190 are respectively formed in the back-pressure grooves 35 arranged in the first and second discharge regions, the present invention is not limited thereto. The protruding opening portions 190 may be respectively formed in all of the back-pressure grooves 34, 35, and 44.

<Fifth Modification>

In the above-described first and second embodiments, the back-pressure groove 35, 235 may be formed such that the depth of the protruding opening portion 190, 290 becomes equal to the depth of the back pressure opening portion 180.

<Sixth Modification>

In the above-described third embodiment, the back-pressure groove 335 may be formed such that the depth of the protruding opening portion 390 becomes shallower than the depth of the back pressure opening portion 380.

<Seventh Modification>

In the above-mentioned embodiment, although a description is given of an example in which the pair of side plates 30 and 40 are provided, the present invention is not limited thereto. For example, the cover-side side plate 40 may be formed integrally with the pump cover 20. In this case, the pump cover 20 functions as a side member that comes into contact with the side surfaces of the rotor 2 and the cam ring 4.

The configurations, operations, and effects of the embodiment of the present invention configured as described above will be collectively described.

The vane pump 100 is provided with the rotor 2 having the plurality of slits 2A formed in a radiating pattern. And the vane pump 100 is provided with the rotor 2, the plurality of vanes 3, the cam ring 4, the body-side side plate 30, the cover-side side plate 40, and the pump chambers 6. The rotor 2 is rotationally driven. The plurality of vanes 3 are received in the slits 2A in a freely slidable manner. The cam ring 4 has the inner circumference cam face 4*a* with which the tip end portions 3*a* of the vanes 3 are brought into sliding contact. The body-side side plate 30 and the cover-side side plate 40 serving as a side member brought into contact with the one-side surfaces of the rotor 2 and the cam ring 4. The pump chambers 6 are formed by the rotor 2, the cam ring 4, and adjacent vanes 3. The back pressure chambers 5 are formed in the slits 2A by the base-end portion 3*b* of the vane 3. The body-side side plate 30 is provided with the back pressure opening portion 180, 380 and the protruding opening portion 190, 290, 390. The back pressure opening portion 180, 380 opens at the sliding-contact surfaces 30*a*, 40*a* in sliding contact with the rotor 2. The back pressure opening portion 180, 380 is configured to communicate with the back pressure chambers 5. The protruding opening portion 190, 290, 390 is protruding along the rotating direction of the rotor 2 from the finishing-end-side semi-arc-shaped surface 183*a*, 383*a* serving as the end portion of the back pressure opening portion 180, 380 on the communication-finishing side, where the communication between the back pressure opening portion 180, 380 and the back pressure chambers 5 finishes as the rotor 2 is rotated. And the inner-side inner circumferential surface 191, 291, 391 of the protruding opening portion 190, 290, 390 is connected to the inner-side inner circumferential surface 181 of the back pressure opening portion 180, 380.

With this configuration, when the base-end portion 3*b* of the vane 3 falls into the back pressure opening portion 180, 380 and when the base-end portion 3*b* of the fallen vane 3 is caught on the inner-side inner circumferential surface 181 of the back pressure opening portion 180, 380, the base-end portion 3*b* of the vane 3 is guided to the inner-side inner circumferential surface 191, 291, 391 of the protruding opening portion 190, 290, 390 from the inner-side inner circumferential surface 181 of the back pressure opening portion 180, 380. Thus, the vanes 3 are not clamped between the inner-side inner circumferential surface 181 of the back pressure opening portion 180, 380 and the inner circumference cam face 4*a* as the vanes 3 are forcedly pushed outwards in the radial direction, and therefore, it is possible to prevent the tip end portions 3*a* of the vanes 3 from being pressed against the inner circumference cam face 4*a*. As a result, it is possible to prevent wear of the inner circumference cam face 4*a* of the cam ring 4.

In the vane pump 100, the tip end portion of the protruding opening portion 190, 290, 390 is set at the position closer to the inner-side inner circumferential surface 181 of the back pressure opening portion 180, 380 than the outer-side inner circumferential surface 182 of the back pressure opening portion 180, 380.

With this configuration, because the tip end portion of the protruding opening portion 190, 290, 390 is arranged towards the vicinity of the inner-side inner circumferential surface 181 of the back pressure opening portion 180, 380, it is possible to ensure the sufficient distance between the inner-side inner circumferential surface 181 of the protruding opening portion 190, 290, 390 and the inner circumference cam face 4*a* of the cam ring 4. As a result, it is possible to suppress an amount of the vanes 3 being pushed outwards in the radial direction of the rotor 2 with the rotation of the rotor 2 by the inner-side inner circumferential surface 191, 291, 391 of the protruding opening portion 190, 290, 390.

In the vane pump 100, the radial length from the inner-side inner circumferential surface 191, 291, 391 of the protruding opening portion 190, 290, 390 to the inner circumference cam face 4*a* of the cam ring 4 is longer than the radial length of the vanes 3.

With this configuration, while the base-end portion 3*b* of the vane 3 is being guided by the inner-side inner circumferential surface 191, 291, 391 of the protruding opening portion 190, 290, 390 of the protruding opening portion 190, 290, 390, the contact between the tip end portions 3*a* of the vanes 3 and the inner circumference cam face 4*a* is avoided.

In the vane pump 100, the outer-side opening edge 392*a* of the protruding opening portion 390 is formed so as to gradually approach the rotation center axis O of the rotor 2 towards the tip end portion of the protruding opening portion 390.

With this configuration, as the rotor 2 is rotated, the base-end portion 3*b* of the vane 3 that has fallen into the back pressure opening portion 380 is gradually lifted up by the outer-side opening edge 392*a* of the protruding opening portion 390, and therefore, it is possible to correct the tilt of the vane 3.

In the vane pump 100, the protruding opening portion 190, 290 and the back pressure opening portion 180 are each formed to have the groove shape, and the height dimension of the protruding opening portion 190, 290 is smaller than the height dimension of the back pressure opening portion 180.

With this configuration, because it suffices to form the protruding opening portion 190, 290 having the groove shape on the finishing-end-side semi-arc-shaped surface 183*a* that is the end portion of the back pressure opening portion 180 on the communication-finishing side, it is possible to achieve reduction in the manufacturing cost.

In the vane pump 100, the back pressure opening portion 180, 380 has the inner-side arc-shaped surface 181*a* and the outer-side arc-shaped surface 182*a*. The inner-side arc-shaped surface 181*a* is formed to have the arc shape extending along the circumferential direction of the rotor 2. The outer-side arc-shaped surface 182*a* is formed to have the arc shape extending along the circumferential direction of the rotor 2. And the inner-side inner circumferential surface 291, 391 of the protruding opening portion 290, 390 is provided so as to be continuous with the inner-side arc-shaped surface 181*a* of the back pressure opening portion 180, 380.

With this configuration, because the inner-side inner circumferential surface 291, 391 of the protruding opening portion 290, 390 is continuous with the inner-side arc-shaped surface 181*a* of the back pressure opening portion 180, 380, it is possible to allow the base-end portion 3*b* of the vane 3 in sliding contact with the back pressure opening portion 180, 380 to move more smoothly into the protruding opening portion 290, 390 as the rotor 2 is rotated.

In the vane pump 100, the protruding opening portion 390 has the base end inner-side arc-shaped surface 391*a*, the outer-side arc-shaped surface 392, and the tip-end inner-side arc-shaped surface 391*b*. The base end inner-side arc-shaped surface 391*a* serving as the first arc-shaped surface extends from the inner-side arc-shaped surface 181*a* so as to be continuous therewith. The outer-side arc-shaped surface 392 serving as the second arc-shaped surface extends from the outer-side arc-shaped surface 182*a* so as to be continuous therewith. The tip-end inner-side arc-shaped surface 391*b* serving as the third arc-shaped surface is configured to connect the base end inner-side arc-shaped surface 391*a* and the outer-side arc-shaped surface 392. And the inner-side arc-shaped surface 181*a*, the outer-side arc-shaped surface 182*a*, and the base end inner-side arc-shaped surface 391*a* are formed to have an arc shape centered at the rotation center axis O of the rotor 2. And the tip-end inner-side arc-shaped surface 391*b* is formed to have an arc shape having its center at the inner side of the protruding opening portion 390, and the radius of the tip-end inner-side arc-shaped surface 391*b* is smaller than the radius of the outer-side arc-shaped surface 392.

With this configuration, because the step is not provided between the back pressure opening portion 380 and the protruding opening portion 390, it is possible to achieve reduction in the manufacturing cost by forming the back pressure opening portion 380 and the protruding opening portion 390 at the same time.

Embodiments of this invention were described above, but the above embodiments are merely examples of applications of this invention, and the technical scope of this invention is not limited to the specific constitutions of the above embodiments.

This application claims priority based on Japanese Patent Application No. 2017-222945 filed with the Japan Patent Office on Nov. 20, 2017, the entire contents of which are incorporated into this specification.

The invention claimed is:

1. A vane pump having a discharge region, comprising:

a rotor having a plurality of slits formed in a radiating pattern, the rotor being rotationally driven;

a plurality of vanes received in the slits in a freely slidable manner;

a cam ring having an inner circumference cam face with which tip end portions of the vanes are brought into sliding contact;

a side member brought into contact with one-side surfaces of the rotor and the cam ring;

pump chambers formed by the rotor, the cam ring, and adjacent vanes; and back pressure chambers formed in the slits by base-end portions of the vanes, wherein the side member is provided with:

a back pressure opening portion opening at a sliding-contact surface in sliding contact with the rotor in the discharge region where the pump chambers are caused to contract as the rotor rotates, the back pressure opening portion being configured to communicate with the back pressure chambers and having an inner-side arc-shaped surface and an outer-side arc-shaped surface that are respectively formed along a circumferential direction of the rotor; and a protruding opening portion protruding along a rotating direction of the rotor from an end portion of the back pressure opening portion on a communication finishing side, where communication between the back pressure opening portion and the back pressure chambers finishes as the rotor is rotated, wherein the protruding opening portion has an inner-side inner circumferential surface that is continuous with the inner-side arc-shaped surface of the back pressure opening portion.

2. The vane pump according to claim 1, wherein a tip end portion of the protruding opening portion is set at a position closer to the inner-side inner circumferential surface of the back pressure opening portion than an outer side inner circumferential surface of the back pressure opening portion.

3. The vane pump according to claim 1, wherein a radial length from the inner-side inner circumferential surface of the protruding opening portion to the inner circumference cam face of the cam ring is longer than a radial length of the vanes.

4. The vane pump according to claim 1, wherein an outer-side opening edge of the protruding opening portion is formed so as to gradually approach a rotation center axis of the rotor towards the tip end portion of the protruding opening portion.

5. The vane pump according to claim 1, wherein the protruding opening portion and the back pressure opening portion are each formed to have a groove shape, and a height dimension of the protruding opening portion is smaller than a height dimension of the back pressure opening portion.

6. The vane pump according to claim 1, wherein the protruding opening portion has:

a first arc-shaped surface extending from the inner-side arc-shaped surface so as to be continuous therewith;

a second arc-shaped surface extending from the outer-side arc-shaped surface so as to be continuous therewith; and a third arc-shaped surface configured to connect the first arc-shaped surface and the second arc-shaped surface, and wherein the inner-side arc-shaped surface, the outer-side arc-shaped surface, and the first arc shaped surface are formed to have an arc shape centered at a rotation center axis of the rotor, the third arc-shaped surface is formed to have an arc shape having its center at an inner side of the protruding opening portion, and a radius of the third arc-shaped surface is smaller than a radius of the second arc shaped surface.

7. The vane pump according to claim 1, wherein the inner-side arc-shaped surface and the outer-side arc-shaped surface are apart from each other in a radius direction of the rotor.

8. The vane pump according to claim 1, wherein the inner-side arc-shaped surface and the outer-side arc-shaped surface have a constant distance therebetween in a radius direction of the rotor.

* * * * *